US011421486B2

(12) United States Patent
Daasvatn et al.

(10) Patent No.: US 11,421,486 B2
(45) Date of Patent: Aug. 23, 2022

(54) OFFLOADING HYDROCARBONS FROM SUBSEA FIELDS

(71) Applicant: Subsea 7 Norway AS, Stavanger (NO)

(72) Inventors: Sigbjorn Daasvatn, Hornnes (NO); Daniel Karunakaran, Tananger (NO)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 16/627,918

(22) PCT Filed: Jul. 3, 2018

(86) PCT No.: PCT/EP2018/067980

§ 371 (c)(1),
(2) Date: Dec. 31, 2019

(87) PCT Pub. No.: WO2019/007975

PCT Pub. Date: Jan. 10, 2019

(65) Prior Publication Data

US 2021/0148173 A1 May 20, 2021

(30) Foreign Application Priority Data

Jul. 3, 2017 (GB) ..... 1710668
Jul. 3, 2017 (NO) ..... 20171092

(51) Int. Cl.
*E21B 17/01* (2006.01)
*E21B 43/01* (2006.01)

(52) U.S. Cl.
CPC ..... *E21B 17/012* (2013.01); *E21B 17/017* (2013.01); *E21B 43/01* (2013.01)

(58) Field of Classification Search
CPC ..... E21B 17/012; E21B 17/017; E21B 43/01
See application file for complete search history.

(56) References Cited

U.S. PATENT DOCUMENTS 3,654,951 A 4/1972 Pogonowski et al.
4,176,986 A 12/1979 Taft et al.
4,182,584 A * 1/1980 Panicker ..... E21B 17/015 405/224.3
4,234,047 A * 11/1980 Mott ..... E21B 17/01 175/5
4,321,720 A * 3/1982 Havre ..... B63B 22/021 441/5
4,436,048 A 3/1984 Gentry et al.
4,547,163 A 10/1985 Langpaap et al.
4,643,614 A * 2/1987 Laursen ..... F16L 1/26 405/169
4,650,431 A 3/1987 Kentosh
(Continued)

FOREIGN PATENT DOCUMENTS

GB 2 133 446 7/1984
GB 2484840 A * 4/2012 ..... B63B 21/00
(Continued)

*Primary Examiner* — Matthew R Buck
(74) *Attorney, Agent, or Firm* — Levy & Grandinetti

(57) ABSTRACT

A subsea hydrocarbon export system includes a riser tower having a riser column extending from a seabed location to a sub-surface buoy that supports the riser column in an upright orientation. A subsea connector is operable underwater to couple the riser column temporarily to a hose suspended from a surface shuttle tanker vessel for an export operation and to release the hose after the export operation.

39 Claims, 17 Drawing Sheets

(56) References Cited

U.S. PATENT DOCUMENTS

| | | | | |
|---|---|---|---|---|
| 4,673,313 | A * | 6/1987 | Baugh | E21B 33/038 405/224.3 |
| 4,793,737 | A | 12/1988 | Shotbolt | |
| 4,878,694 | A * | 11/1989 | Castel | F16L 1/26 285/24 |
| 5,275,510 | A | 1/1994 | de Baan et al. | |
| 5,657,823 | A | 8/1997 | Kogure et al. | |
| 6,042,303 | A * | 3/2000 | Head | E21B 33/038 405/195.1 |
| 6,453,838 | B1 | 9/2002 | Mowell et al. | |
| 6,461,083 | B1 * | 10/2002 | Pionetti | E21B 17/015 166/350 |
| 6,688,348 | B2 | 2/2004 | Fontenot | |
| 7,059,416 | B2 * | 6/2006 | Dailey | E21B 17/012 166/359 |
| 7,367,398 | B2 * | 5/2008 | Chiesa | E21B 17/01 166/272.1 |
| 7,934,560 | B2 * | 5/2011 | Roveri | E21B 17/012 166/345 |
| 8,047,297 | B2 * | 11/2011 | Millheim | E21B 17/012 166/367 |
| 8,733,446 | B2 * | 5/2014 | Espinasse | E21B 17/015 166/350 |
| 8,960,304 | B2 * | 2/2015 | Luppi | E21B 17/015 166/350 |
| 9,011,045 | B2 | 4/2015 | Muniz-Martinez | |
| 9,115,543 | B2 | 8/2015 | Pionetti | |
| 9,222,317 | B2 * | 12/2015 | Yemington | E21B 19/002 |
| 9,399,847 | B2 * | 7/2016 | Luppi | F16L 1/15 |
| 9,670,740 | B2 * | 6/2017 | Hallai | E21B 17/012 |
| 2002/0115365 | A1 | 8/2002 | Nish et al. | |
| 2003/0084960 | A1 | 5/2003 | Fontenot | |
| 2003/0180097 | A1 | 9/2003 | Fitzgerald et al. | |
| 2004/0126192 | A1 | 7/2004 | Nish et al. | |
| 2005/0042952 | A1 | 2/2005 | Montbarbon | |
| 2005/0241832 | A1 | 11/2005 | Jones et al. | |
| 2006/0000615 | A1 * | 1/2006 | Choi | F25J 3/04563 166/352 |
| 2006/0021756 | A1 | 2/2006 | Bhat et al. | |
| 2008/0056826 | A1 * | 3/2008 | Luppi | E21B 17/015 405/171 |
| 2010/0059230 | A1 | 3/2010 | Skeels | |
| 2011/0253027 | A1 * | 10/2011 | Legras | B63B 22/025 405/224.2 |

FOREIGN PATENT DOCUMENTS

| | | |
|---|---|---|
| GB | 2500102 | 9/2013 |
| GB | 2504065 | 1/2014 |
| WO | WO 85/03494 | 8/1985 |
| WO | WO 98/14363 | 4/1998 |
| WO | WO 99/00579 | 1/1999 |
| WO | WO 99/42358 | 8/1999 |
| WO | WO 02/076816 | 10/2002 |
| WO | WO 03/051710 | 6/2003 |
| WO | WO 2006/059220 | 6/2006 |
| WO | WO 2006/090102 | 8/2006 |
| WO | WO 2009/117901 | 10/2009 |
| WO | WO 2012/051148 | 4/2012 |
| WO | WO 2012/051149 | 4/2012 |
| WO | WO 2013/037012 | 3/2013 |
| WO | WO 2014/060717 | 4/2014 |
| WO | 2015/022477 | 2/2015 |

* cited by examiner

OFFLOADING HYDROCARBONS FROM SUBSEA FIELDS

This invention relates to offshore offloading solutions for exporting hydrocarbon fluids, such as oil produced from subsea wells.

Offshore exploration for oil and gas is being performed in ever more challenging waters, with fields now being developed in water depths of 3000 m or more. To recover hydrocarbons from such depths, designers of riser and offloading systems face difficult technical challenges. Those challenges may be compounded by metocean characteristics and by low reservoir temperatures.

The invention also arises from the challenges of developing marginal subsea oil fields, including small, remote or inaccessible fields. Addressing those challenges requires the cost of production and of capital investment to be minimised.

A typical subsea oil production system comprises production wells each with a wellhead, pipelines running on the seabed, structures to support valves and connectors, manifolds and risers to bring production fluids to the surface. At the surface, a topside installation that can be a platform or a vessel receives the production fluids before their onward transportation.

Crude oil is a multiphase fluid that generally contains sand, oil, water and gas. These components of the wellstream interact in various ways that tend to decrease the flow rate in the production system, from the wellhead to storage. A critical failure mode in crude oil production is clogging or plugging of pipelines by solids because remediation of such blockages can be extremely expensive, especially in deep water.

When the temperature of a wellstream decreases below a certain threshold, at a given pressure, components of crude oil may react together or individually to coagulate or precipitate as solid wax, asphaltenes or hydrates that could plug a pipeline. For example, wax will typically appear in oil at a temperature of around 30° C.

As crude oil is hot at the outlet of a wellhead, typically around 200° C., one approach in subsea oil production is to maintain the oil temperature above the critical threshold until the oil has been delivered to a topside installation. There, the oil can be treated to allow the treated oil to be transported at ambient temperature in tankers or in pipelines.

Two main approaches are known in the art to reduce the cost of producing oil from subsea fields, especially marginal subsea fields. A first approach is to simplify subsea equipment as much as possible, for example by using a long, insulated and optionally also heated pipeline extending from a wellhead and minimal additional equipment subsea. Where fields are isolated or remote, a challenge of that approach is that the cost of installing and optionally heating the long pipeline becomes a large element of the cost of development and operation.

Marginal fields requires low-cost solutions. In many cases, particularly for isolated fields, it is important to remove the pipeline cost. One alternative is to use a subsea storage unit to store produced crude oil before offloading. For example, crude oil may be stored in an inflatable bag on the seabed.

Thus, the present invention arises from a second approach, namely to transfer at least some conventionally-topside production and storage functions to a subsea location for intermittent export of oil by shuttle tanker vessels. This involves subsea separation, processing and storage of produced oil. By displacing at least some oil processing steps from the topside to the seabed, the need for thermal insulation or heating can be reduced and ideally, in principle, removed.

It follows that there is a need periodically to offload oil that has been processed and stored subsea whenever transfer to a tanker vessel is required.

Many solutions are known for offshore offloading of hydrocarbon fluids. Most involve exporting such fluids from a surface or topside storage facility to a tanker that is fluidly connected to the topside storage facility. Usually, hose storage systems are located on the topside facility. For example, in WO 99/42358 the topside storage facility is a floating storage and offloading (FSO) vessel and in WO 2015/22477, the topside storage facility is a buoyant SPAR platform. WO 99/00579 and WO 98/14363 also disclose SPAR platforms, which in these examples are connected to a subsea storage facility.

Topside storage facilities such as FSOs and SPARs are complex and bulky structures that are very costly. Additionally, connecting them to a tanker can be challenging.

A tanker may connect to an offloading buoy, also located at the surface. The offloading buoy is fluidly connected to a line at or near to the surface known as an offloading line (OLL) that is picked up by the tanker and hauled aboard for connection. This does not remove the need for surface systems.

Sometimes, partial storage is provided by a surface buoy as disclosed in WO 2009/117901. U.S. Pat. Nos. 6,688,348 and 5,275,510 disclose another export system in which a near-surface termination buoy supports an export hose.

Permanent risers are known, for example as disclosed in WO 2013/037002, U.S. Pat. Nos. 6,453,838, 5,657,823 and in US 2008/0056826, connected by flexible jumper pipes to a floating production storage and offloading (FPSO) vessel or other surface facility. A drawback of this arrangement is its permanence: an FPSO must be on station continuously to process hydrocarbons flowing from the riser; similarly, the jumper pipes between the riser and the FPSO are a permanent system that will typically remain in place until the riser is decommissioned. An additional export system from the FPSO to a shuttle tanker remains necessary, either directly or via a buoy as described above. Additional systems comprising permanent risers connected via flexible jumper pipes to an FPSO are also described in US 2005/0042952 and U.S. Pat. No. 4,436,048, although emergency disconnection of the jumpers from the buoy is possible in these systems. US 2002/0115365 and US 2003/0180097 both describe permanent risers that extend from the seabed to a floating surface platform. US 2005/0241832 describes the provision of buoyancy elements coupled in series with section of a riser to provide support to the riser between the surface platform and the seabed.

WO 2006/090102 discloses a tank system anchored to the seabed.

In WO 85/03494 a visiting tanker connects directly to a subsea storage tank. In U.S. Pat. No. 3,654,951, an export hose is folded onto a subsea storage tank. This is not realistic for deep-water systems because the hose would be impractically long and would be likely to be crushed by hydrostatic pressure.

WO 02/076816 discloses a subsea storage tank and export riser tensioned by a subsea buoy. The subsea buoy retains a hose and a mooring line that are accessible near the surface from any tanker. This places permanent lines and other equipment within the splash zone, just below the surface, where sea dynamics are influential. This generates fatigue in hoses, lines and other equipment. There is also a risk of clashing with vessels at the surface. US 2006/0000615 and GB 2133446 also describe systems comprising export risers that are tensioned by sub-surface buoys, in which export hoses are retained by the buoys and are accessible from a tanker for the export operation.

Thus, a drawback of prior art solutions is the requirement for expensive development that makes exploitation of small, remote fields uneconomical. Another drawback is the presence of permanent equipment at or just below the sea surface, generating a risk of clashing with vessels and fatigue caused by sea motion. Also, prior art solutions rely on surface units, which makes them unsuitable for use in deep water.

Against this background, the invention resides in a subsea hydrocarbon export system that comprises: a riser tower having a column, particularly a riser column or pipe, extending from a seabed location to a sub-surface buoy that supports the column in an upright orientation; and a subsea connector that is operable underwater to couple the column temporarily to a hose suspended from a surface shuttle tanker vessel for an export operation and to release the hose after the export operation.

The column preferably communicates with a subsea tank for storing hydrocarbon fluids, which subsea tank may serve as a foundation for the riser tower. It is also possible for the column to communicate with a subsea processing system for processing hydrocarbon fluids. Indeed, the subsea processing system may also serve as a foundation for the riser tower. A subsea pump is suitably provided for pumping hydrocarbon fluids up the column to the subsea connector.

The subsea connector suitably comprises a connector element at an upper extremity of the column. For example, the connector element may conveniently be an upwardly-facing socket for receiving a plug connector element of the hose.

The column may extend through the buoy. The buoy suitably surrounds an upper end portion of the column and may comprise shell elements that are assembled together around the upper end portion of the column.

The column may comprise a connection between a major lower section and a minor upper section, the buoy being attached to the upper section of the column.

There may be at least one laterally-projecting male formation on the column, which formation may be engaged with a female interlocking formation of the buoy. Such a male formation suitably surrounds the column and could be formed integrally with the column.

The buoy may comprise a sleeve fixed to and surrounding the column. In that case, an upper cross-member may extend laterally from the sleeve, which cross-member suitably supports one or more lifting points. The upper cross-member may also support one or more attachment points for the attachment of at least one clump weight. Conveniently, one or more buoyant elements of the buoy may bear against an underside of the upper cross-member to apply buoyant upthrust via the upper cross-member in use.

A lower cross-member may also extend laterally from the sleeve and suitably supports one or more attachment points for the attachment of at least one clump weight. One or more buoyant elements of the buoy may rest upon the lower cross-member.

A bend restrictor may be attached to the buoy to extend along and around the column under the buoy. For example, the bend restrictor may be attached to a lower cross-member of the buoy.

At least one clump weight may be releasably attached to the buoy. Such a clump weight may comprise a chain or could be a rigid structure attachable to the buoy. In either case, the buoy may comprise one or more external tubes or sockets that open upwardly to receive at least one clump weight.

In specific embodiments, the or each clump weight may be at least part of a ring that extends circumferentially around the buoy. It is also possible for the or each clump weight to comprise at least one downwardly-extending pin for engagement with one or more respective sockets of the buoy. In that case, the or each clump weight may comprise a pair of those pins, one pin of the pair being longer than the other pin of the pair.

Advantageously, the buoy may comprise non-floodable buoyancy such as rigid buoyant foam or macrospheres.

The hose is suitably a bonded polymer composite hose. Whilst the hose is preferably longitudinally flexible, there may be a rigid guide structure at a distal end of the hose. Preferably, the column is of pipe that can be wound onto a reel or carousel onboard an installation vessel, without substantial plastic deformation of the pipe. For example, the column is suitably of bonded polymer composite pipe. More generally, the column is advantageously of a material that is substantially neutrally buoyant in sea water.

The inventive concept embraces a related method of exporting hydrocarbon fluids from a seabed location. That method comprises: sailing a shuttle tanker vessel to a surface export location above a column, such as a riser column or pipe, that extends from the seabed location to a sub-surface buoy, which buoy supports the column in an upright orientation; suspending a hose from the vessel to reach the column; operating a subsea connector underwater to couple the hose temporarily to the column for an export operation; during the export operation, causing hydrocarbon fluids to flow from the seabed location up the column and along the coupled hose to the vessel; and on completion of the export operation, releasing the hose from the column, lifting the hose to the vessel and sailing the vessel away from the surface export location.

The hydrocarbon fluids may be stored at the seabed location before the export operation or may be processed at the seabed location before or during the export operation. The hydrocarbon fluids are suitably pumped at the seabed location during the export operation to flow up the column.

The inventive concept extends to a related method of installing a subsea hydrocarbon export system. That method comprises: lowering a major lower section of a column, such as a riser column or pipe, into water beneath an installation vessel; suspending the lower section from the installation vessel; positioning a buoy and a minor upper section of the column over the suspended lower section; joining the upper section to the lower section to complete the column; and lowering the buoy and the completed column into the water beneath the installation vessel to anchor a lower end of the column at a seabed location, the buoy then being at a sub-surface location.

The lower section of the column may be unwound from shipboard storage while launching that lower section into the water. Preferably the buoy and the upper section are raised from a stowed position on the installation vessel into an upright orientation when positioning them over the suspended lower section.

Ballast may be added to the buoy before lowering the buoy and the completed column into the water beneath the installation vessel. The added ballast may then be removed from the buoy after anchoring the lower end of the column at the seabed location. To achieve this, one or more clump weights may be attached to the buoy to add the ballast, for example by inserting at least part of a clump weight into an upwardly-opening external tube or socket on the buoy. The or each clump weight may then be removed from the buoy to remove the added ballast. In that case, the or each clump weight may be attached to the buoy at a level beneath a mid-point of the buoy, preferably to a lower end region of the buoy. Alternatively, the or each clump weight may be attached to an upper end region of the buoy.

In summary, the invention provides for offloading from a subsea storage unit to a transport tanker at the surface. Hydrocarbon fluids such as oil flow from a feed pump at the seabed and up a riser to a sub-surface buoy that supports the riser. A low differential pressure riser system comprises a composite pipe that is nearly neutrally buoyant in sea water.

At its lower end, the upright composite pipe of the riser is connected by a remotely-operated connector to piping running from the feed pump, which pumps crude oil from the subsea storage unit to the offloading system.

Before offloading, a shuttle tanker positions itself above the known coordinates of the buoy. The buoy will be within a circular area of movement dependent on current and wave interactions. The shuttle tanker lowers a hose with a connector at the lower end that is capable of locating the buoy and the associated connection geometry. The shuttle tanker moves the connector into alignment with the buoy and connects to a hub on top of the buoy. For example, the shuttle tanker can employ a dynamic positioning system to move the connector laterally to the appropriate position. Offloading of oil can then start. After offloading, the shuttle tanker will disconnect from the buoy and depart.

To achieve offloading from subsea storage, embodiments of the invention provide for composite pipe material to be used in the riser section, supported in an upright orientation by standardised, industrial buoyancy elements. Floodable buoyancy is not necessary—only compact buoyancy and associated clump weights for installation. This results in very low weights. Also, the hose is lowered from a tanker vessel to the buoy instead of the traditional approach of pulling a flexible hose up to the deck of a tanker.

Thus, the present invention uses the development of subsea processing to simplify the offloading equipment and process. A tanker vessel connects directly to a subsea buoy by a hose, preferably a bonded polymer composite hose. The hose should be sufficiently flexible to be stored onboard the tanker, yet sufficiently stiff to be easily guided to the subsea connector. The hose should also be strong enough to withstand the pressures to which it will be exposed in use—both internal fluid pressure and external hydrostatic pressure at the depth of the buoy.

Embodiments of the invention provide an underwater hydrocarbon export system comprising: a tower comprising a sub-surface buoy and a riser column between the seabed and the buoy; and a temporary hose hoisted from surface vessel; wherein the sub-surface buoy comprises a subsea connector for subsea connection and disconnection of the temporary hose for hydrocarbon export.

WO 2014/060717 shows a typical connector that may be used to allow connection between the buoy and the hose despite substantial misalignment.

The export system may also comprise a subsea storage tank on the seabed. In that case, the bottom of the riser column may be fluidly and/or mechanically connected to the subsea storage tank. The riser column is suitably of bonded polymer composite pipe.

The buoy is suitably connected to the hose between 30 m and 200 m, more preferably between 75 m and 150 m, below the water surface. The buoy may comprise at least two split half-shells.

The new system proposed by the invention employs a composite, substantially neutral riser that is exposed to the current at the relevant depth. This system is lightweight due to its materials and is therefore nearly independent of depth, easy to install from a reel and requires less resources. A lighter system requires lower buoyant forces to keep the riser upright, and can be anchored either directly by a subsea processing unit or by a simple foundation.

The invention allows a standardised, more reliable system in which moving parts are located at the upper end of the system, while the lower part of the system is largely static. Appropriate modifications may be made to a shuttle tanker loading hose system, and offloading from a storage tank may require an associated subsea feed pump.

In order that the invention may be more readily understood, reference will now be made, by way of example, to the accompanying drawings, in which.

Figure 1:
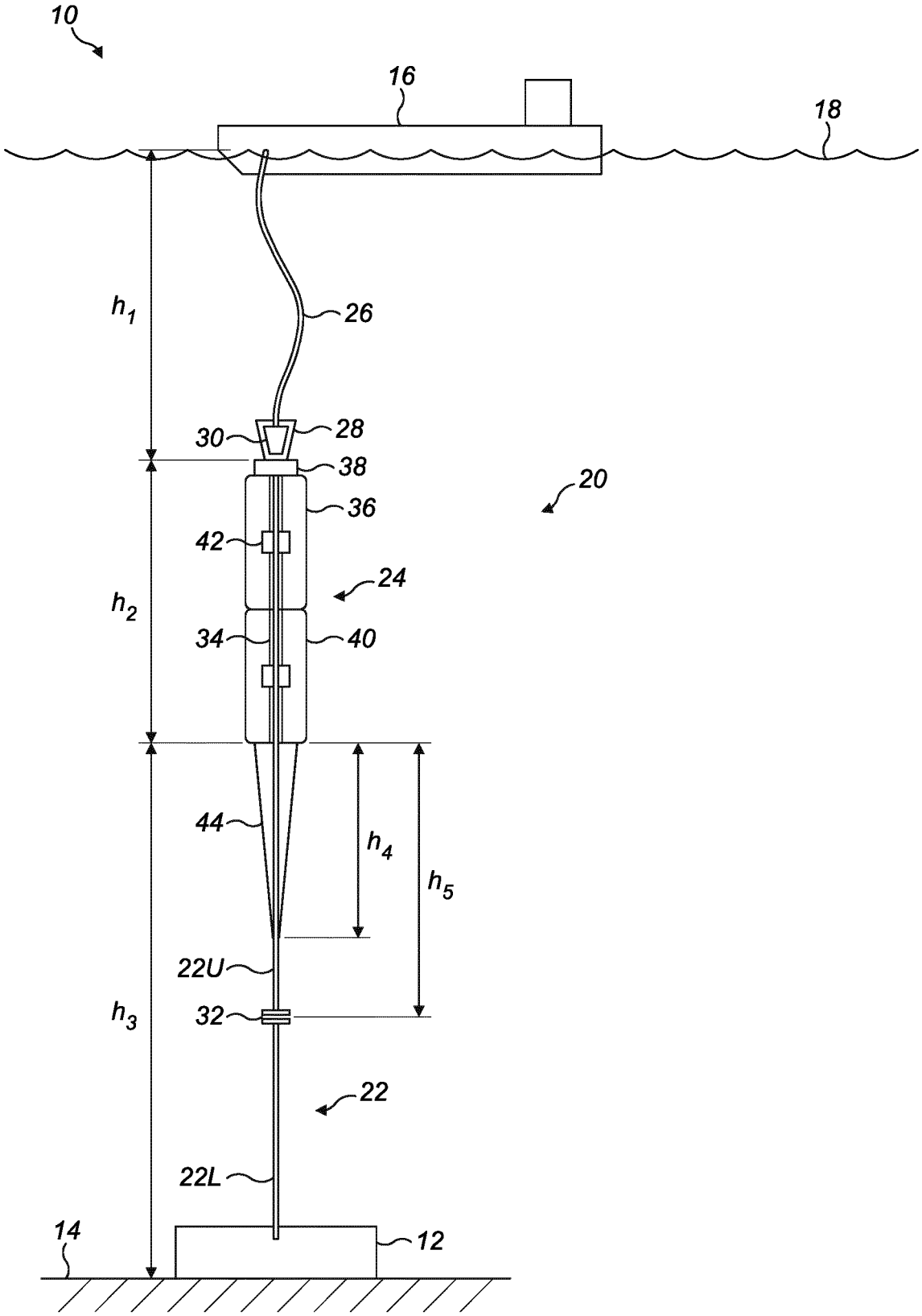
FIG. 1 is a schematic side view of an offloading system in accordance with the invention, showing a tanker connected to the system to offload production fluids from subsea storage.
Figure 4:
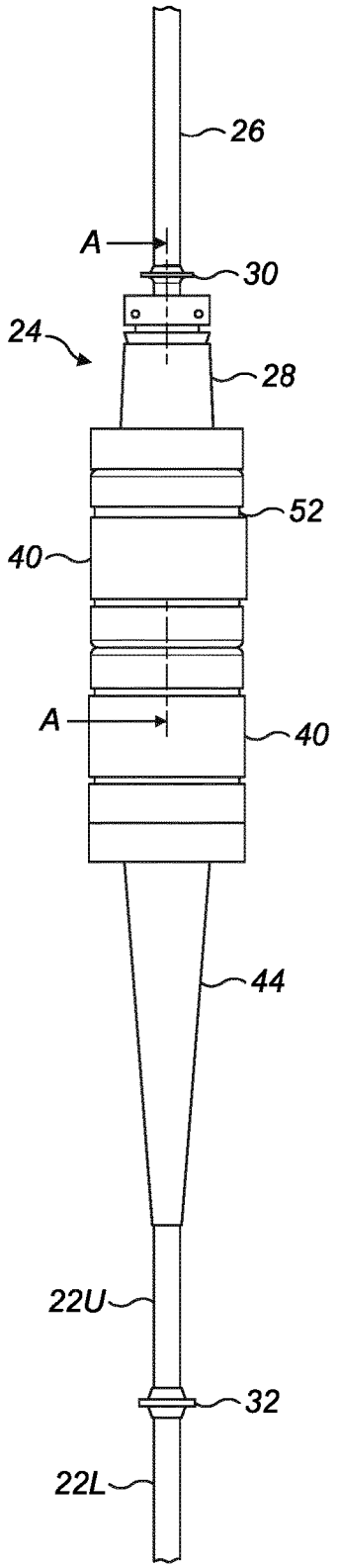
FIG. 4 is a side view of the buoy of FIG. 3.
Figure 6:
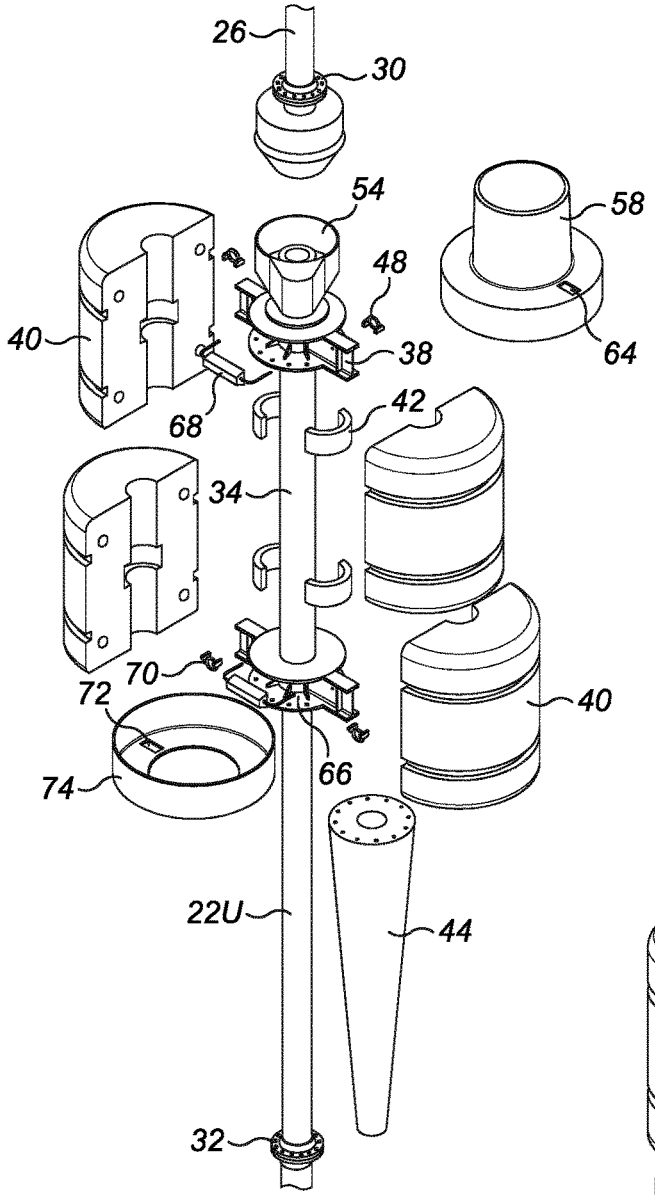
FIG. 6 is an exploded perspective view of the buoy of FIG. 3 and a riser column to which the buoy is attached.
Figure 7:
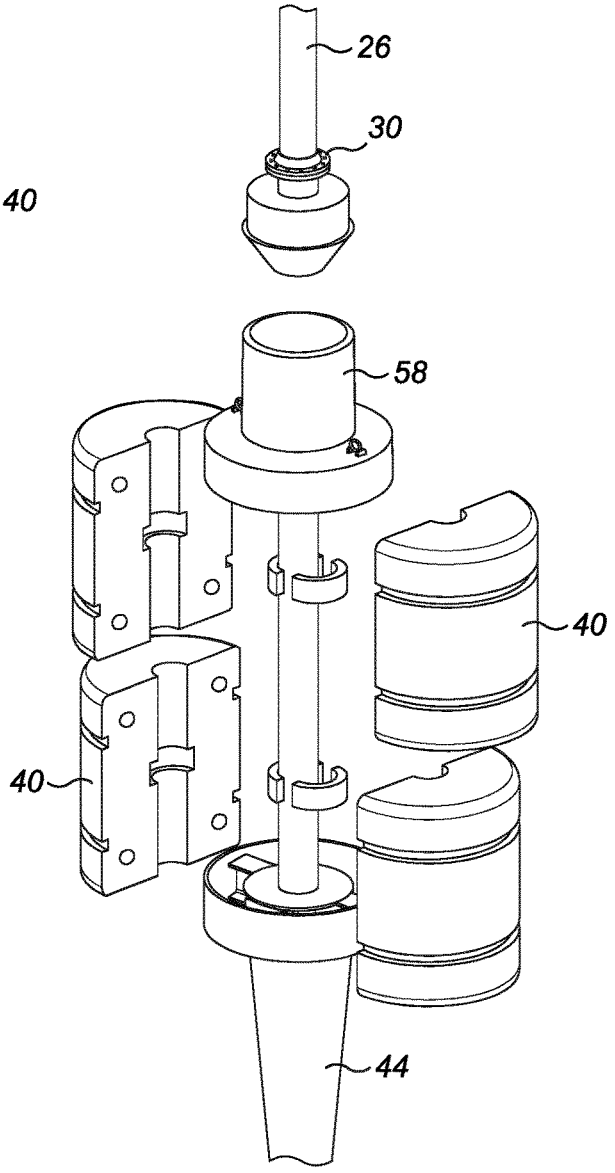
Figure 8:
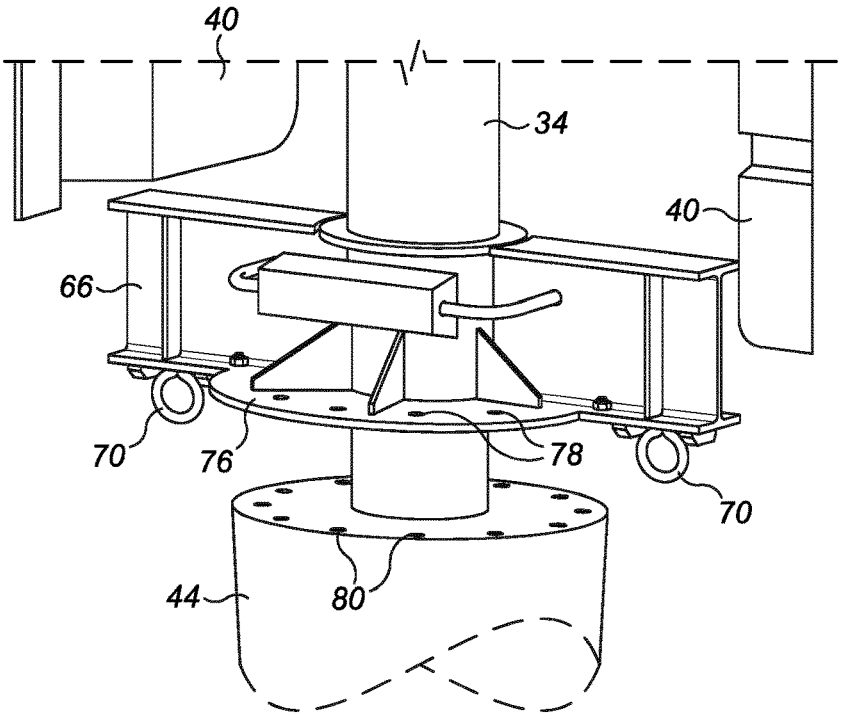
Figure 9:
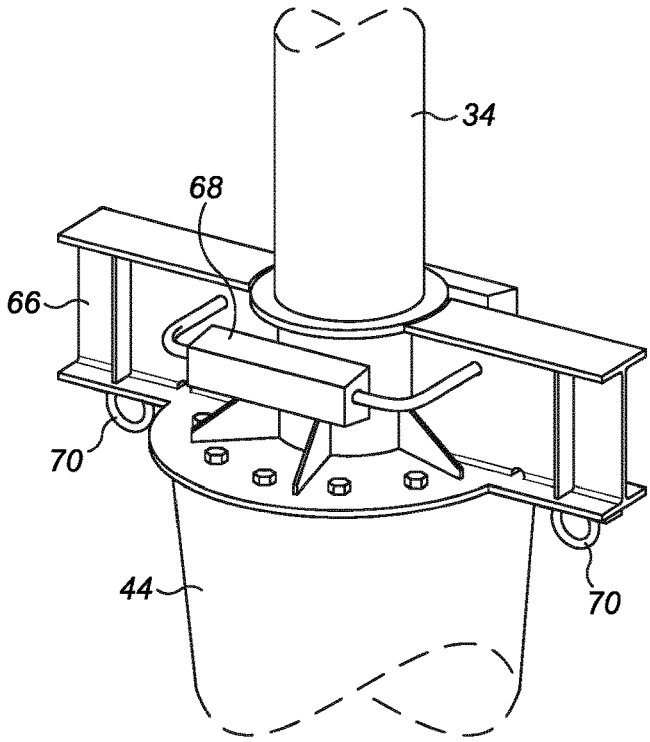
Figure 10:
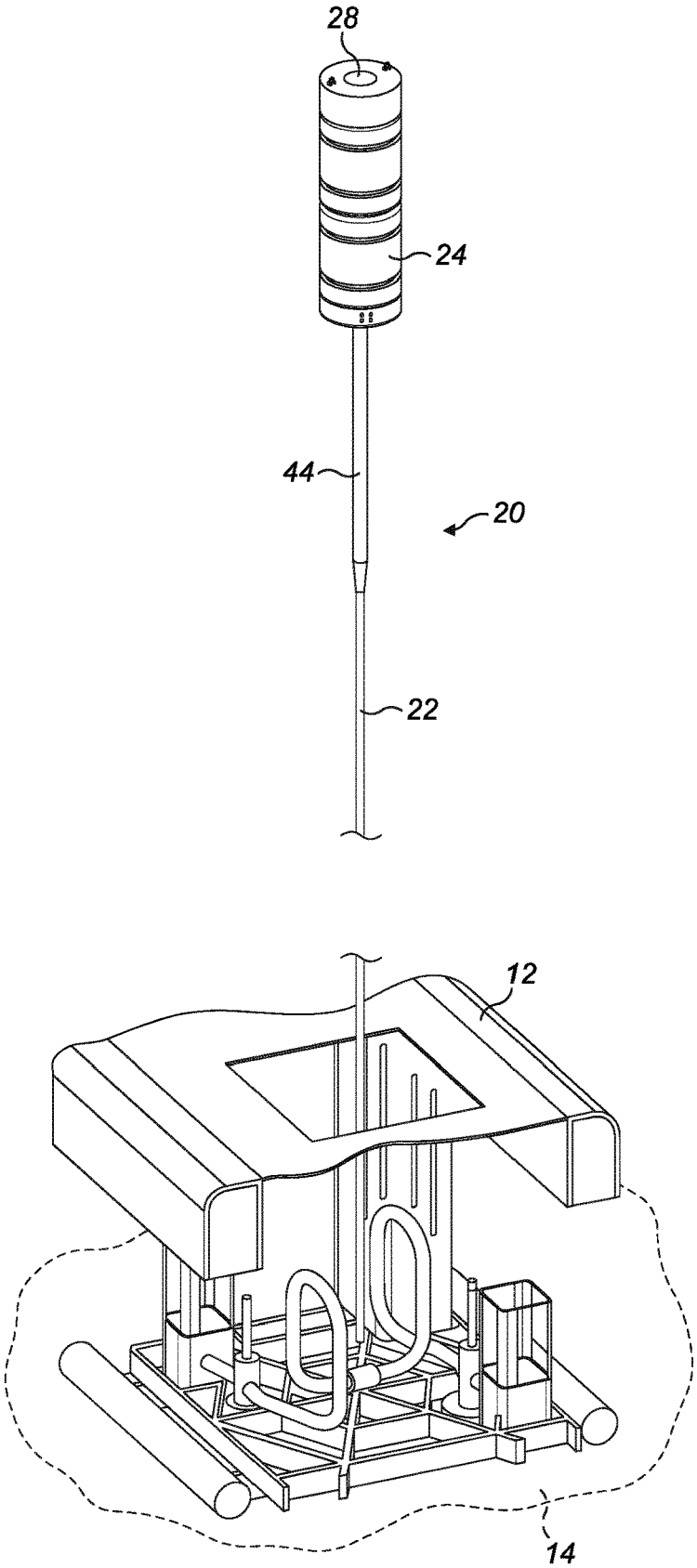
Figure 11:
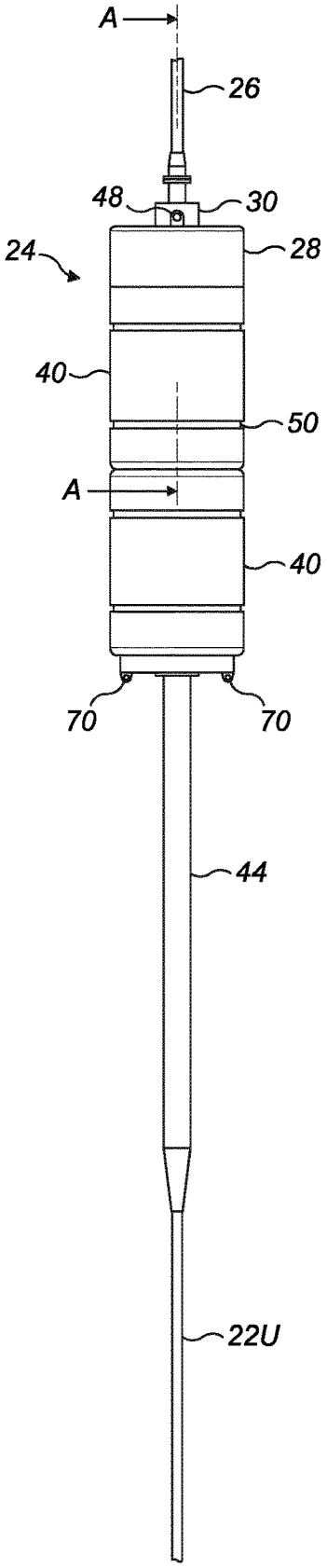
Figure 12:
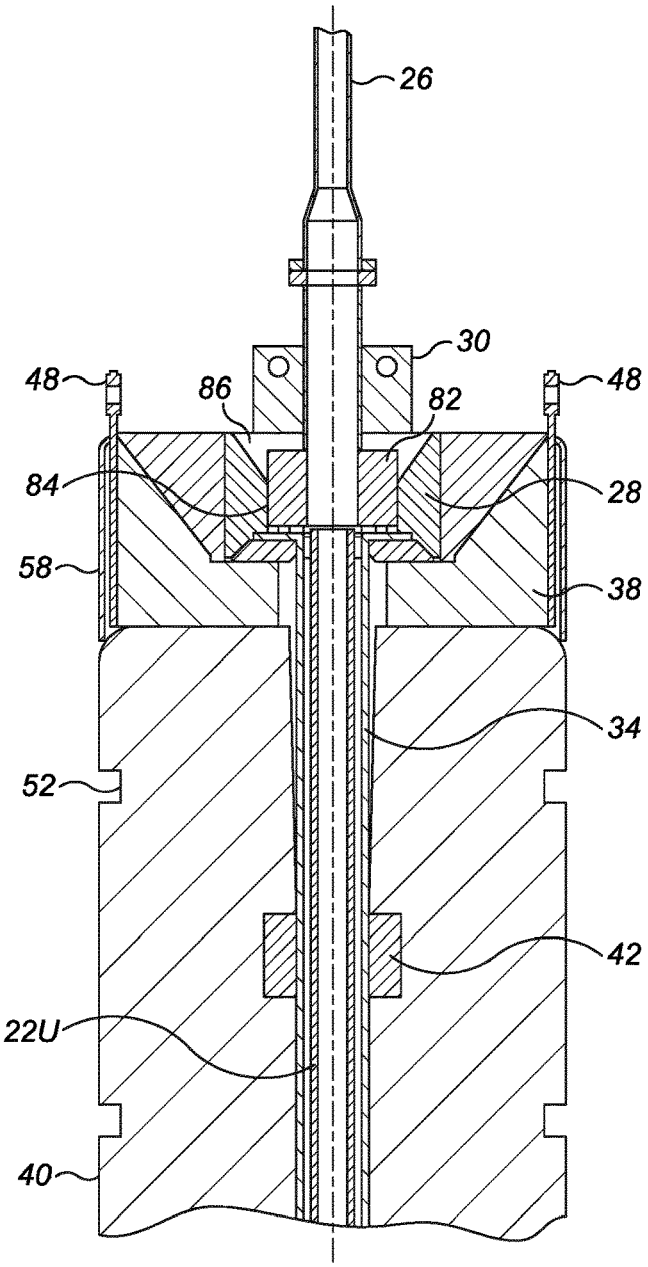
Figure 13:
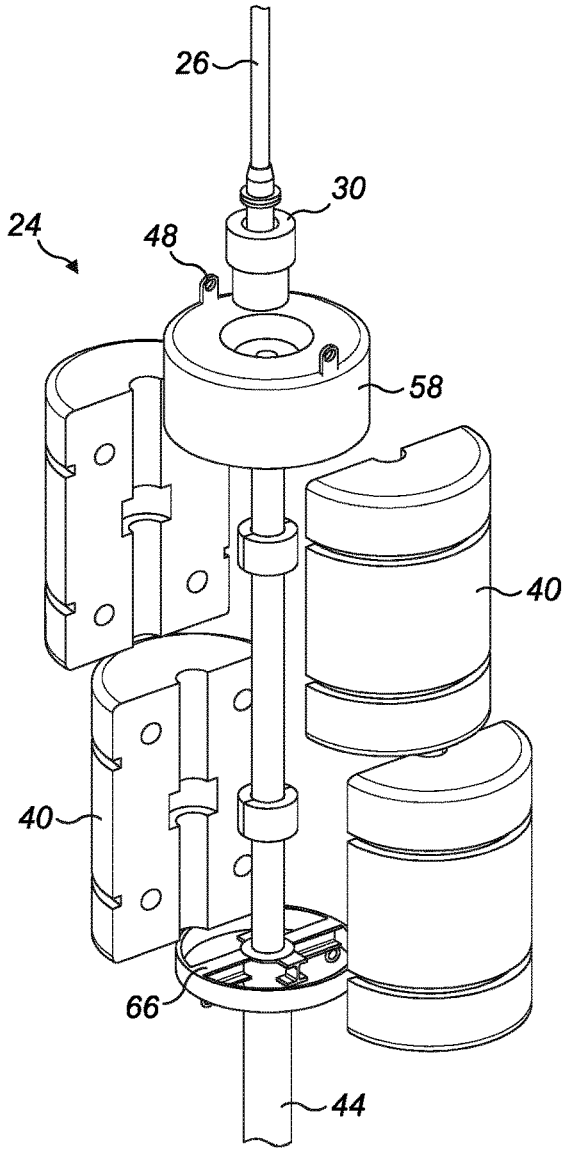
Figure 14:
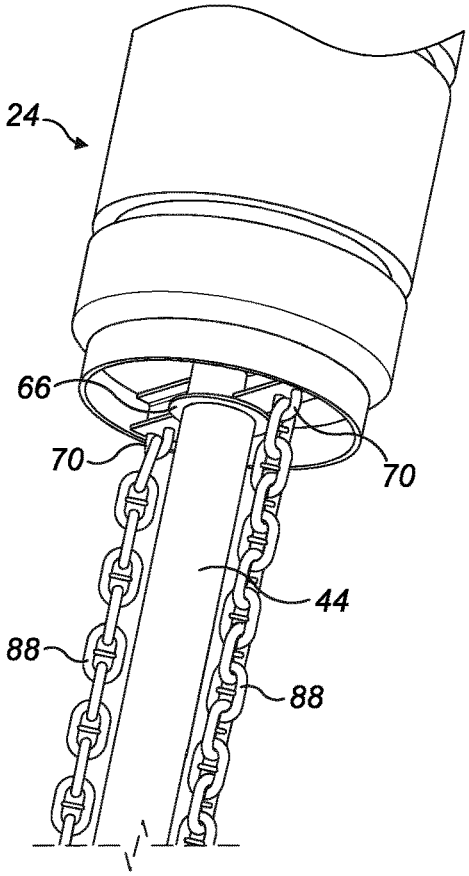
Figure 15:
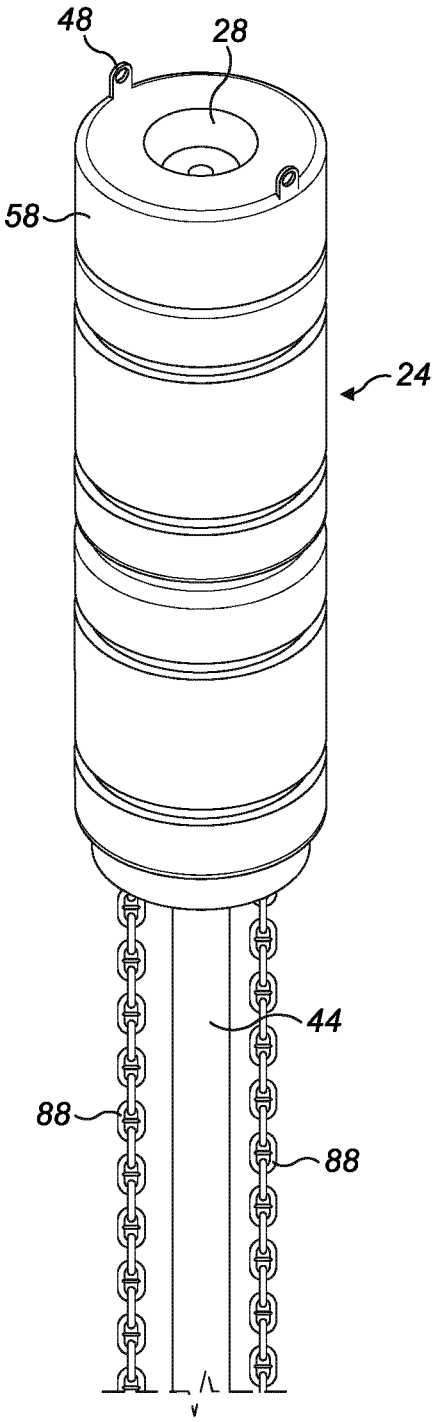
Figure 16:
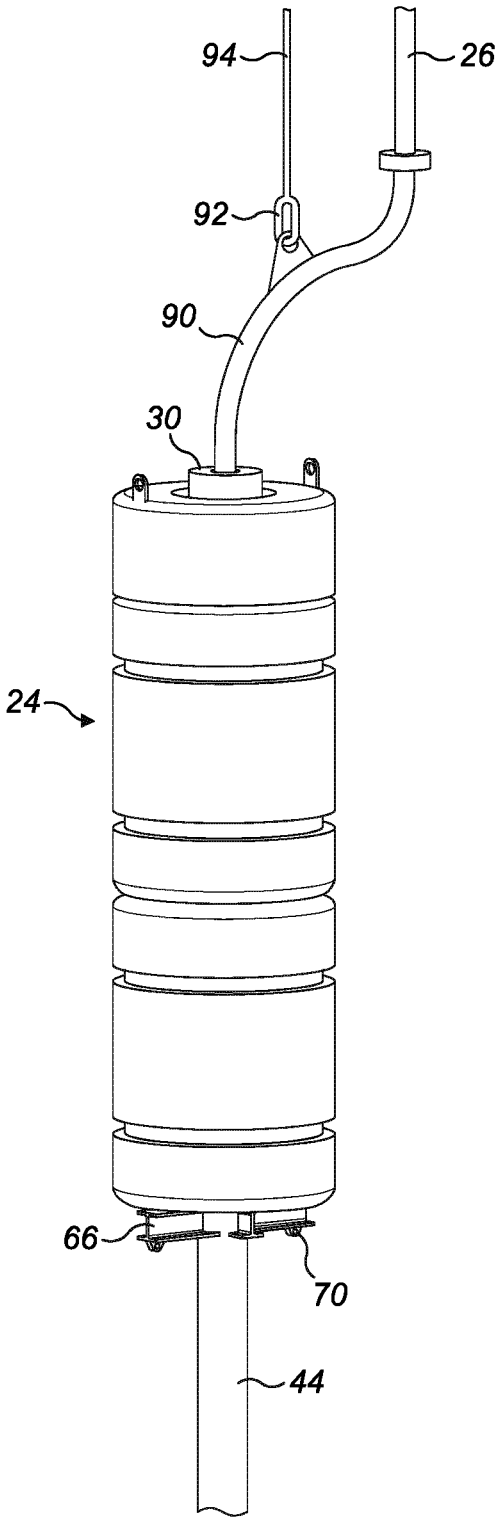
Figure 17:
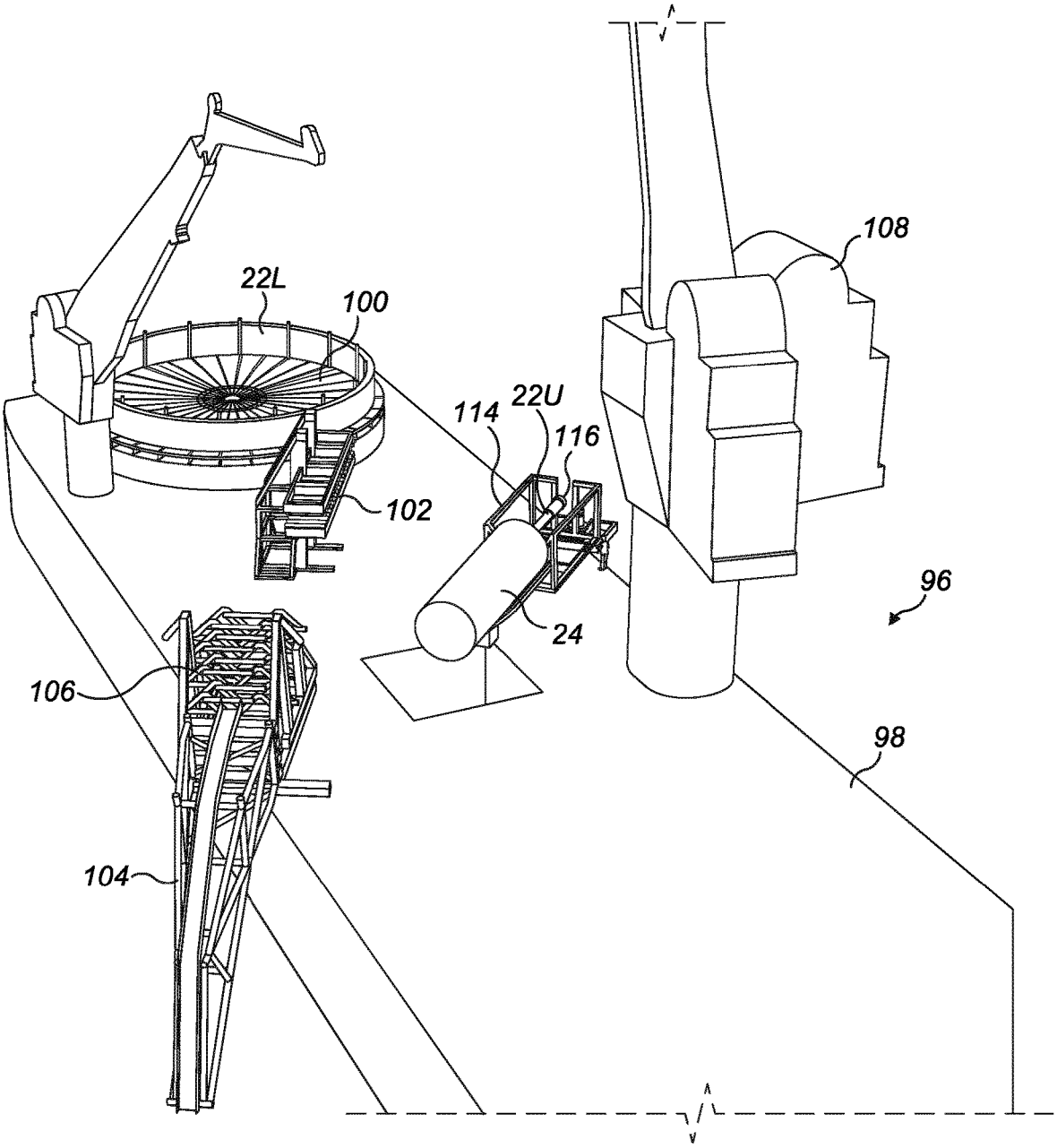
Figure 18:
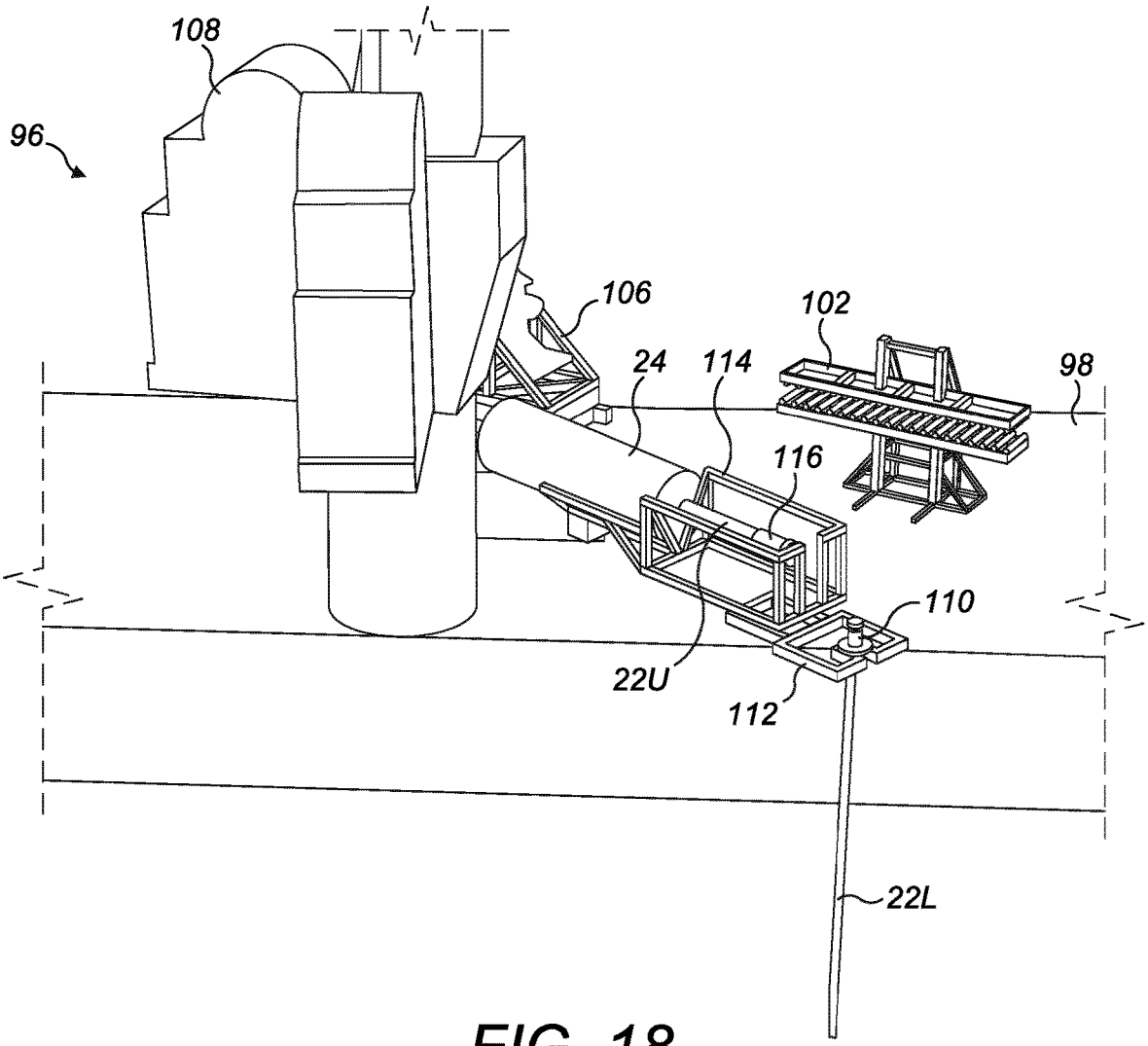
Figure 20:
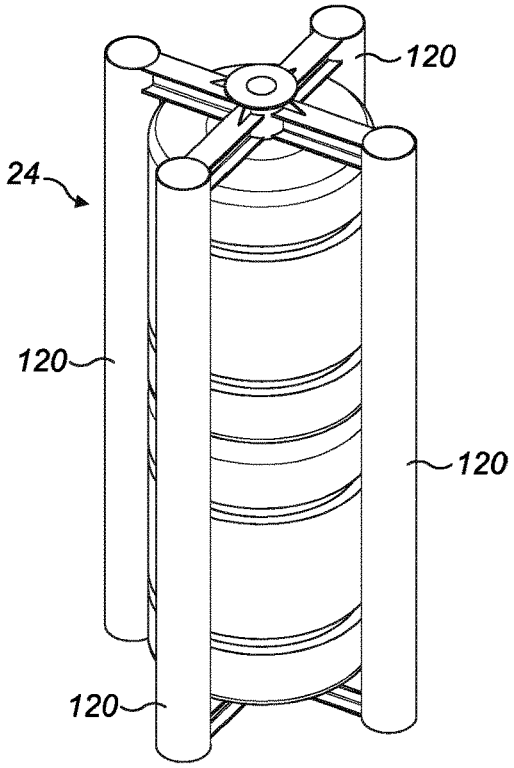
Figure 21:
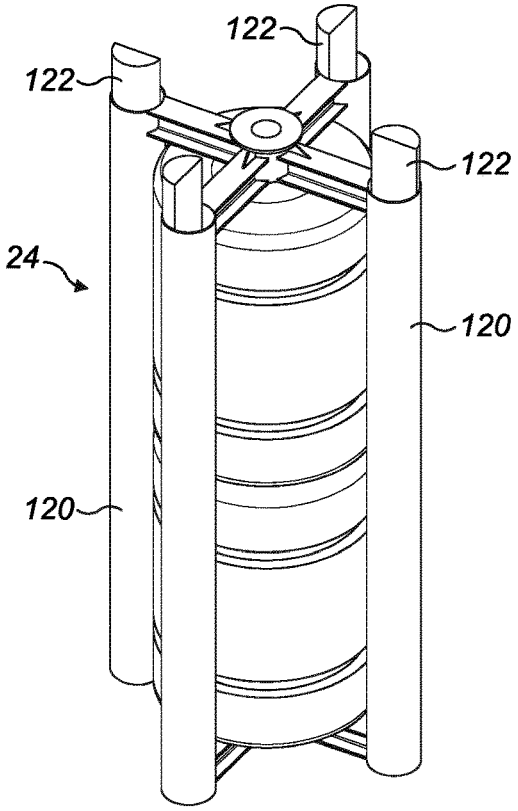
Figure 22:
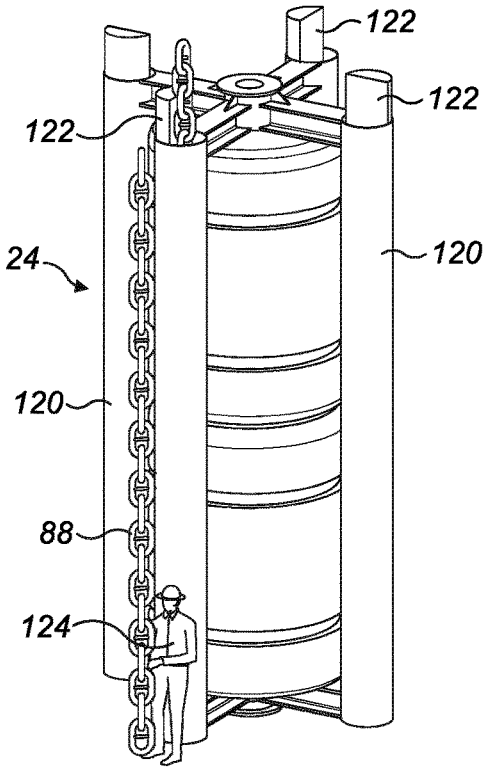
Figure 23:
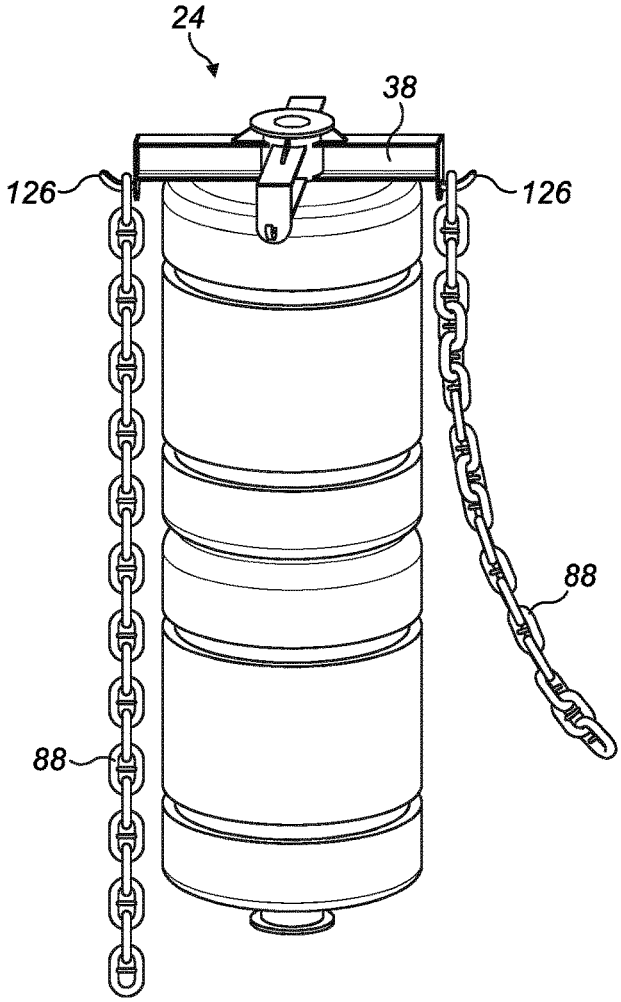
Figure 24:
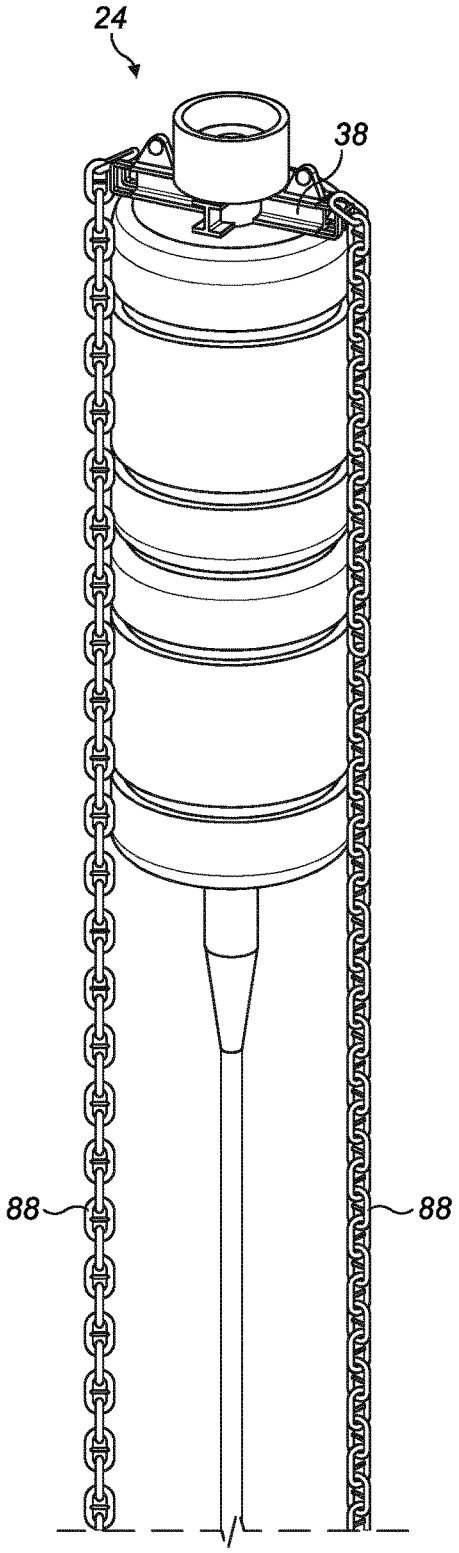
Figure 25:
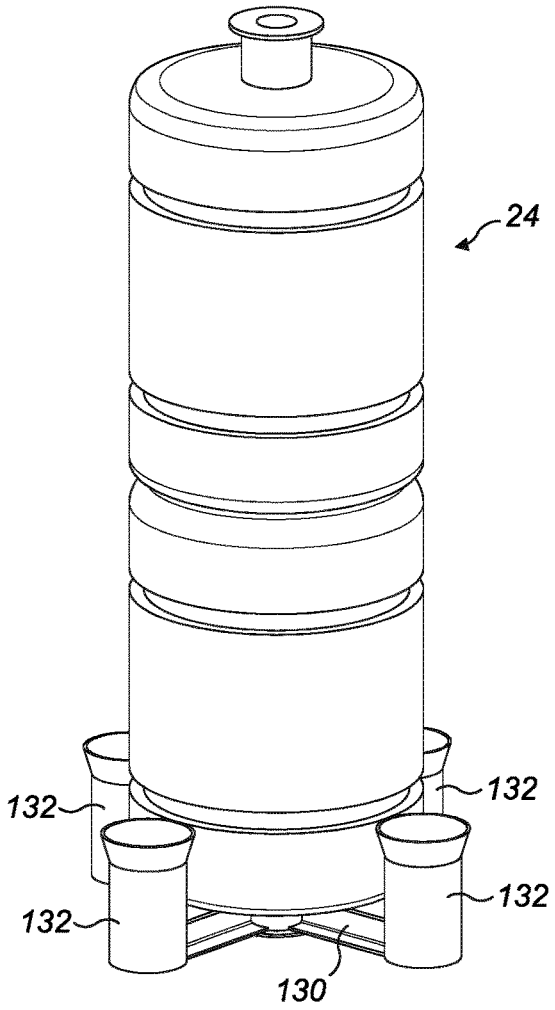
Figure 26:
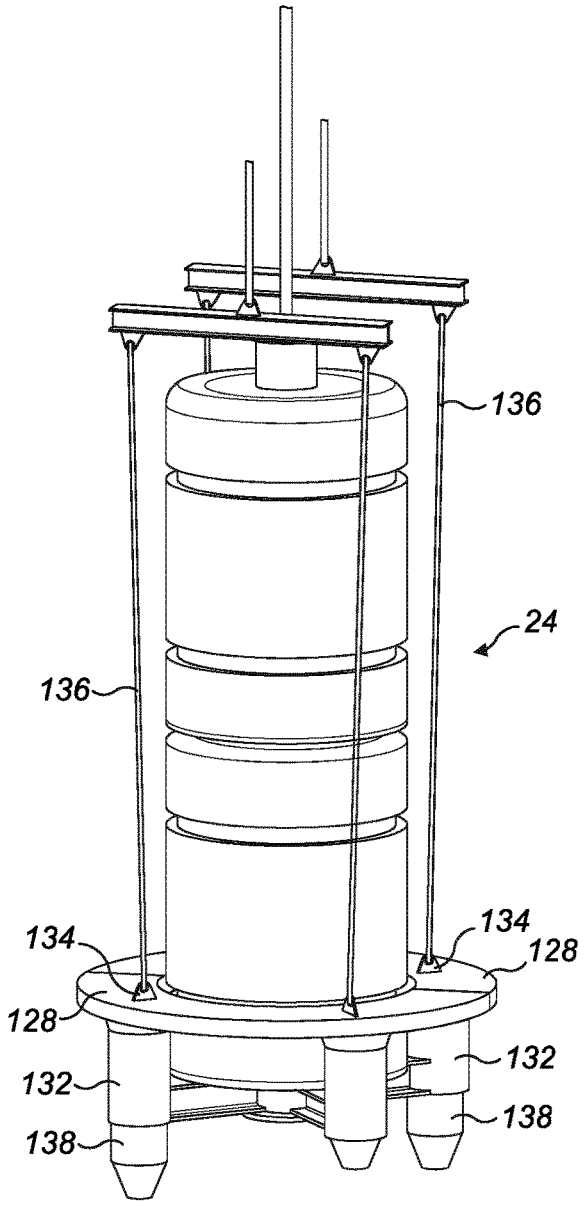
Figure 27:
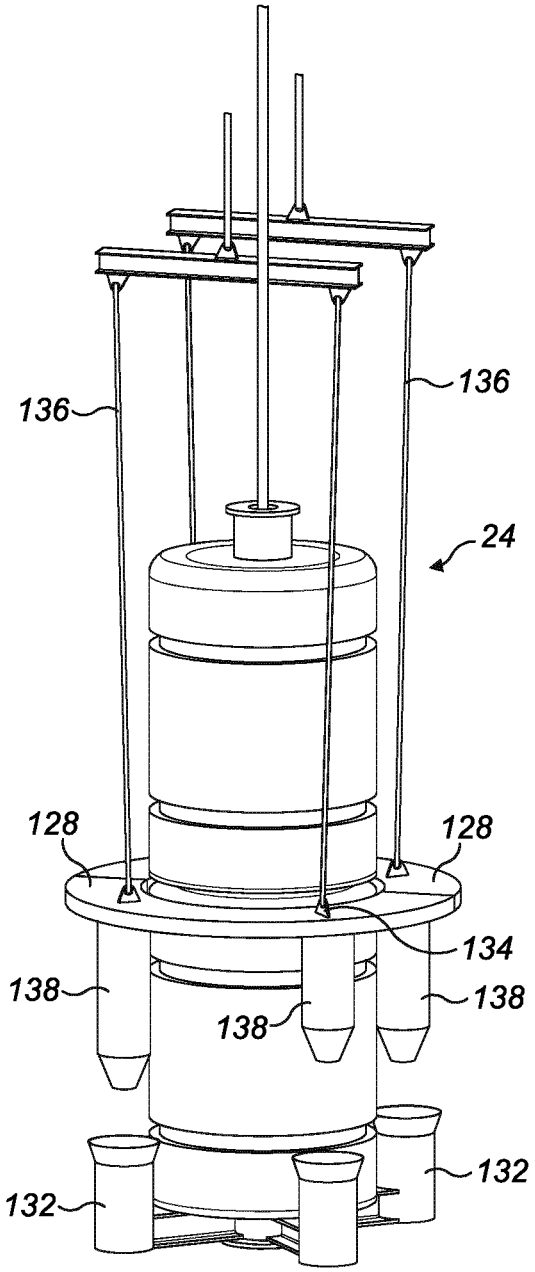
Figure 28:
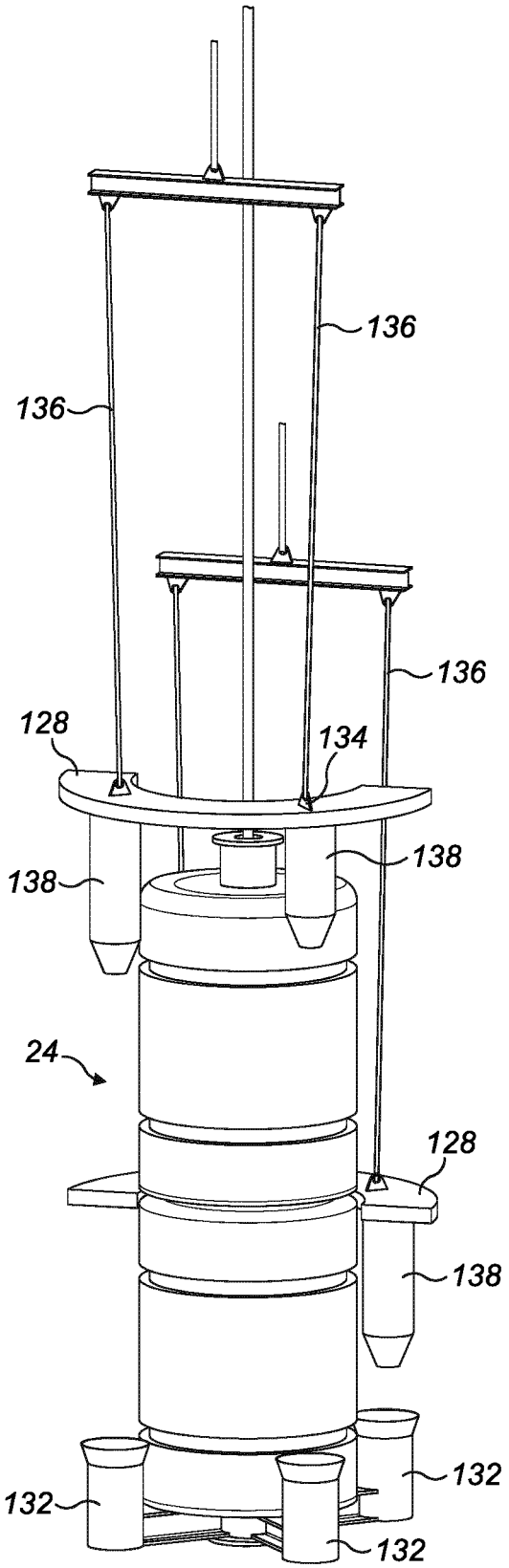

FIG. 7 corresponds to FIG. 6 but shows the buoy partially assembled around the riser column;

FIG. 8 is a detail perspective view of a lower cross-member of the buoy;

FIG. 9 corresponds to FIG. 8 but shows a bend restrictor attached to the lower cross-member;

FIG. 10 is a perspective view that corresponds to FIG. 1 but shows a variant of an offloading system of the invention;

FIG. 11 is a side view that corresponds to FIG. 4 but shows the buoy in the variant of FIG. 10;

FIG. 12 is a sectional side view on line A-A of FIG. 11;

FIG. 13 is an exploded perspective view of the buoy of FIG. 11 and a riser column to which the buoy is attached;

FIG. 14 is a perspective view of the buoy of FIG. 11 from beneath, showing how clump weight chains may be attached to the buoy;

FIG. 15 is a perspective view corresponding to FIG. 14 but from above;

FIG. 16 is a perspective view of the buoy of FIG. 11, showing an alternative hose arrangement that may also be used in the embodiment of FIGS. 1 to 9;

FIG. 17 is a perspective view of an installation vessel that is configured to install the riser column and to attach the buoy to the riser column to form a riser tower;

FIG. 18 corresponds to FIG. 17 but shows the installation vessel from the other side;

FIGS. 19*a* to 19*e* are a series of schematic side views of the installation vessel of FIGS. 17 and 18 when assembling and installing a riser tower;

FIG. 20 is a perspective view of a variant of the buoy of FIG. 13 showing an alternative clump weight support;

FIGS. 21 and 22 are perspective views that correspond to FIG. 20 but show clump weight arrangements held by the clump weight support;

FIGS. 23 and 24 are perspective views of a variant of the buoy of FIG. 13 showing alternative clump weight arrangements;

FIG. 25 is a perspective view of another variant of the buoy of FIG. 13 showing a further alternative clump weight support; and FIGS. 26 to 28 are perspective views showing how various clump weights can be engaged with and disengaged from the clump weight support of FIG. 25.

Referring firstly to FIG. 1 of the drawings, an offloading system 10 of the invention comprises a subsea processing and/or storage facility 12 that lies on the seabed 14. The facility 12 optionally processes and temporarily stores crude oil before periodically offloading the oil to a visiting shuttle tanker 16 that floats on the surface 18 above the facility 12.

For this purpose, a riser tower 20 extends upwardly from the subsea facility 12 to an upper end beneath the surface 18. The riser tower 20 comprises a composite riser pipe 22 that is kept upright and under tension by a buoy 24 at or near to its upper end.

Conveniently, in this example, the riser tower 20 is anchored by the weight of the subsea facility 12. However, other well-known foundation arrangements such as weights or piles could be used to anchor the riser tower 20 to the seabed 14 instead.

The upper end of the riser pipe 22 includes interface features for mating with, and fluid connection to, a flexible hose 26 that hangs under the surface 18 from the tanker 16. When the hose 26 is engaged with the riser pipe 22 in this way, fluid communication is effected between the subsea facility 12 and the tanker 16 via the riser pipe 22 and the hose 26.

The interface features shown here at the upper end of the riser pipe 22 comprise an upwardly-facing socket 28 that receives a plug connector 30 on the free end of the hose 26. However, it would be possible to have alternative interface features, such as a plug connector on the upper end of the riser pipe 22 that mates with a socket at the end of the hose 26.

In this example, the buoy 24 surrounds a short upper section 22U of the riser pipe 22 that implements the interface features at the upper end of the riser pipe 22. A flange connection 32 joins the upper section 22U end-to-end to a much longer lower section 22L of the riser pipe 22. The lower section 22L may extend from the connection 32 all the way down through the water column to the subsea facility 12.

Within the buoy 24, the upper section 22U of the riser pipe 22 is surrounded by a fixed tubular sleeve 34 in concentric, telescopic relation. The buoy 24 further comprises a tubular buoyant body 36 that surrounds the sleeve 34. The buoyant body 36 may comprise one or more hollow chambers, may be formed of rigid buoyant material such as syntactic foam or may comprise a mass of rigid buoyant macrospheres, depending upon the hydrostatic pressure expected at the operational depth The buoyant body 36 bears against an upper cross-member 38 that is fixed to the sleeve 34 above the buoy 24. Consequently, buoyant upthrust of the buoyant body 36 exerted via the upper cross-member 38 and the sleeve 34 imparts tension in the riser pipe 22. The sleeve 34 and the upper cross-member 38 are suitably of steel and so are apt to be welded together.

In this example, the buoyant body 36 comprises shells 40 of part-circular cross-section that are brought together and fixed together as an annulus, for example by clamping under tension applied to external straps, closely to encircle the sleeve 34 and the upper section 22U of the riser pipe 22 within the sleeve 34. In this example, there are two sets of shells 40 stacked one above the other. There could be only one such set of shells 40 or more than two such sets of shells 40.

In addition to the upper cross-member 36, the shells 40 are located against axial movement along the riser pipe 22 by engagement of locating formations on an inner side of each shell 40 with complementary locating formations on an outer side of the sleeve 34. The locating formations are exemplified here by male formations on the sleeve 34 that engage with female formations of the shells 40. Specifically, axially-spaced collars 42 encircle the sleeve 34 to engage with grooves on an inner side of each shell 40.

The collars 42 may be attached to the sleeve 34 by welding, clamping and/or by bonding. Alternatively the sleeve 34 could be omitted. In that case, the collars 42 may be clamped or bonded directly to the riser pipe 22 or could be formed integrally with the riser pipe 22 by locally thickening the wall of the riser pipe 22 to increase its external diameter.

An optional bend restrictor 44 surrounds the upper section 22U of the riser pipe 22 immediately beneath the buoy 24. Conveniently, the bend restrictor 44 is attached to the underside of the buoy 24 and tapers downwardly as shown here. However, as will be explained, other bend restrictor arrangements are possible.

With reference to FIG. 1, exemplary dimensions are set out below for ease of understanding. These dimensions are provided only to put the invention into context and are not intended to be limiting.

$h_1$—the depth of the top of the riser tower 20 beneath the surface 18—75 m;

$h_2$—the height of the buoy 24—7.5 m;

$h_3$—the height of the riser tower 20 from the seabed 18 to the bottom of the buoy 24—50 m to >2000 m $h_4$—the length of the bend restrictor 44—5 m; and $h_5$—the protruding length of the upper section 22U between the bottom of the buoy 24 and the connection 32—10 m.

Reference is now made to FIGS. 2 to 9 to describe a specific embodiment of the offloading system 10 in more detail.

Figure 2:
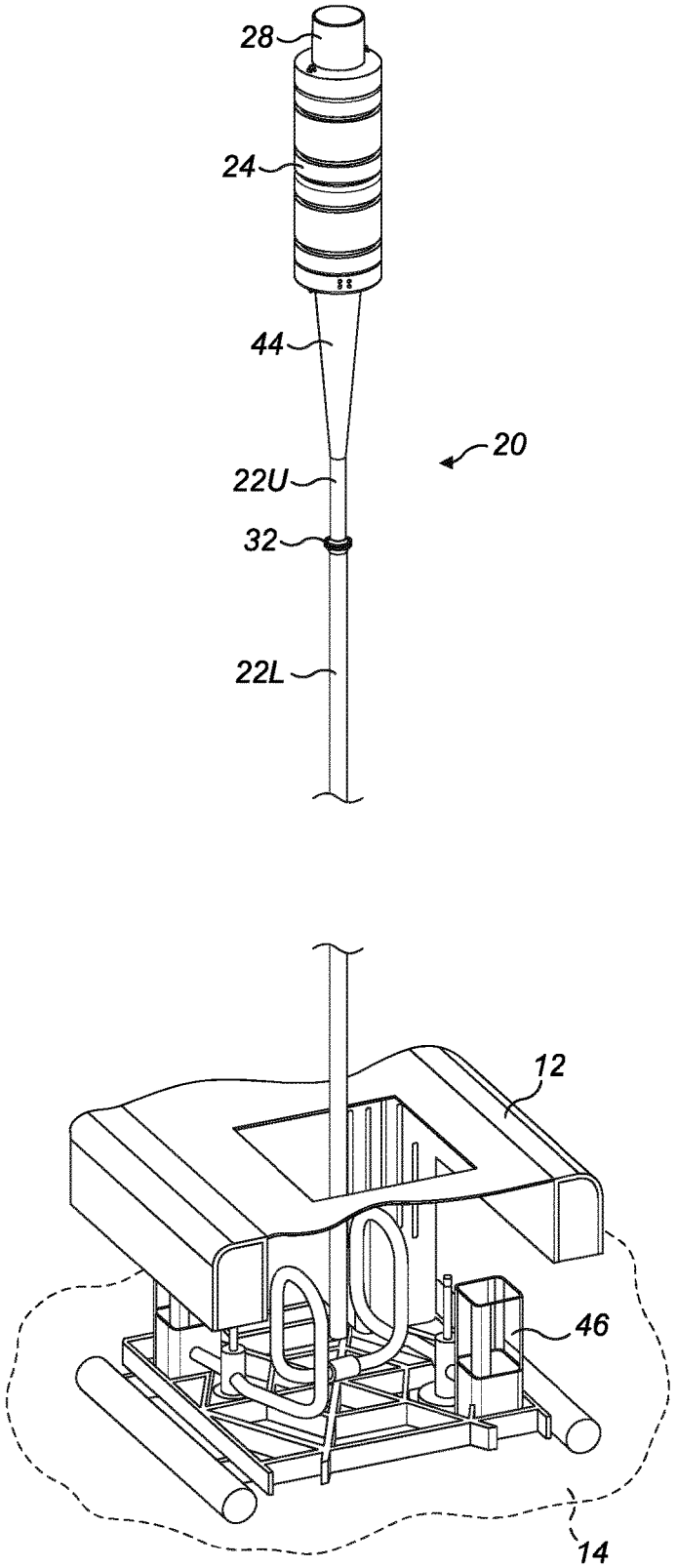
FIG. 2 is a perspective view of an embodiment of an offloading system in accordance with FIG. 1.

FIG. 2 shows that the subsea facility 12 includes a feed pump 46, which during offloading pumps crude oil from the facility 12 up the riser pipe 22 and the hose 26 to the tanker 16.

Figure 3:
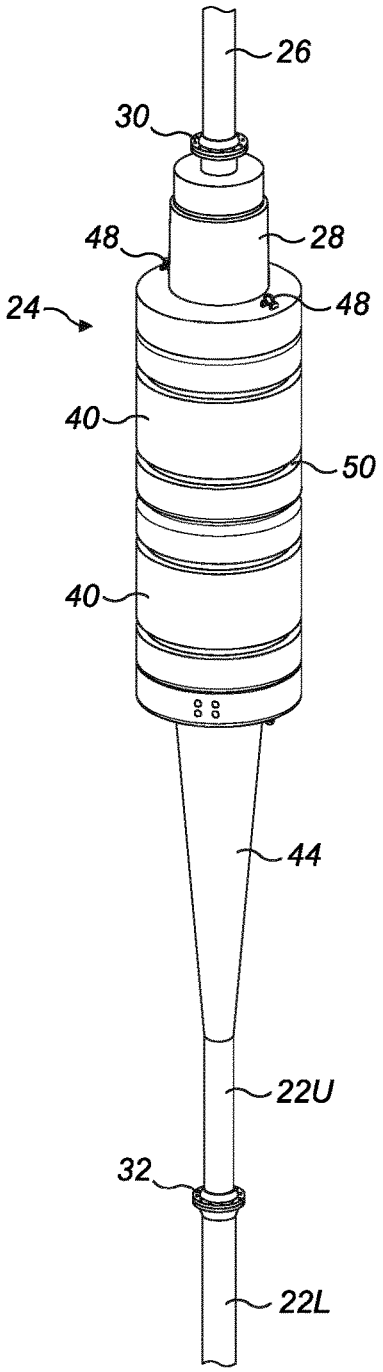
FIG. 3 is an enlarged perspective view of a buoy being part of the offloading system of FIG. 2, now coupled to a hose suspended from the tanker.

The upwardly-facing socket 28 at the upper end of the riser pipe 22 is shown in FIG. 2 ready for engagement with a plug connector 30 of a hose 26 suspended from a tanker 16. FIG. 3 shows the plug connector 30 of the hose 26 now engaged with the socket 28.

The enlarged view of FIG. 3 shows further details of the top of the riser tower 20, namely upwardly-protruding lifting padeyes 48 for attachment of lifting lines during installation, and straps 50 that tightly encircle the shells 40 of the buoyant body 36. The straps 48 are received in respective circumferential grooves 52 that are best appreciated in the similarity-enlarged side view of FIG. 4.

Figure 5:
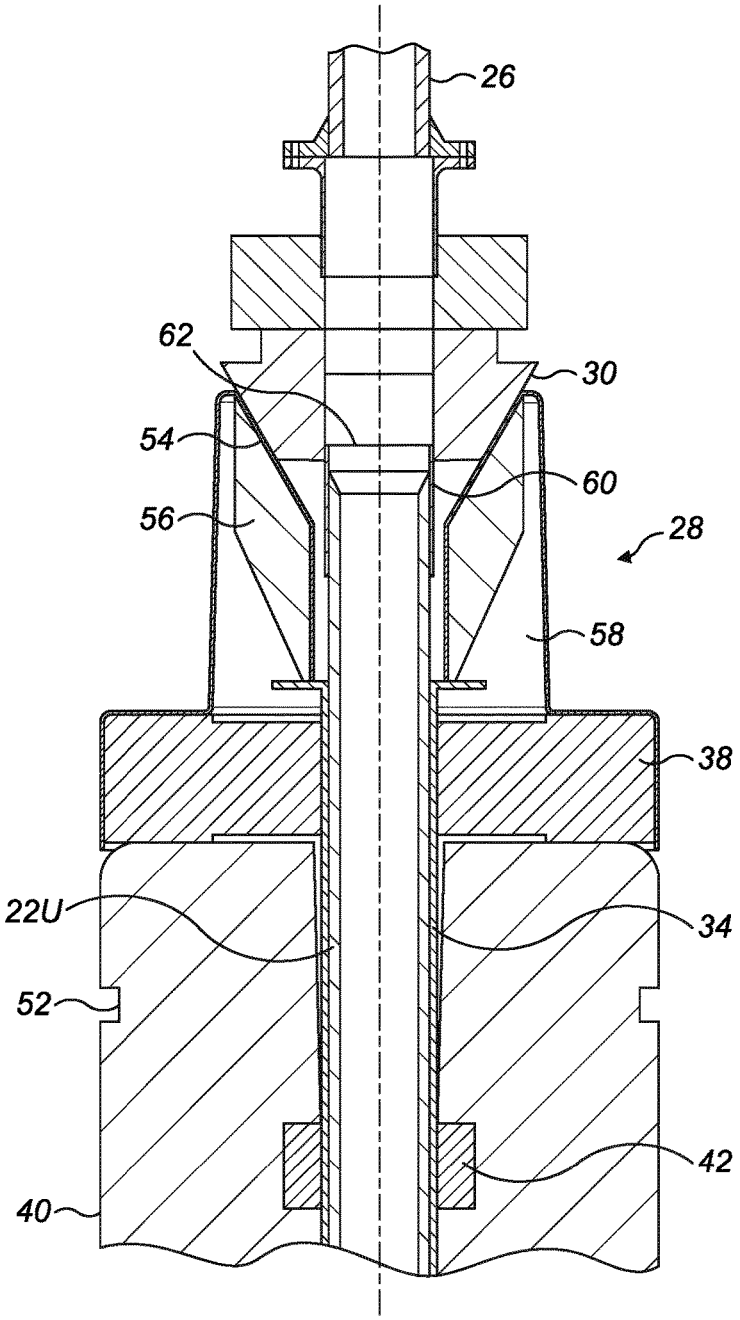
FIG. 5 is a sectional side view on line A-A of FIG. 4.

The further enlarged sectional view of FIG. 5 shows details of the interface between the riser pipe 22 and the hose 26, effected via the socket 28 and the complementary plug connector 30.

The socket 28 is defined by a tubular steel funnel 54 fixed to the top of the sleeve 34. The funnel 54 is stiffened by radial webs 56 and is surrounded by a tubular upper housing 58. The funnel 54 and the plug connector 30 have complementary frusto-conical mating surfaces that guide those parts into mutual alignment as the plug connector 30 moves downwardly.

The upper section 22U of the riser pipe 22 is shown here extending concentrically within the sleeve 34 and protruding from the sleeve 34 into the funnel 54. The protruding end of the riser pipe 22 is surrounded by a steel collar 60. When the plug connector 30 engages within the funnel 54, the collar 60 is received in a complementary recess 62 in a distal end face of the plug connector 30.

FIGS. 6 and 7 are exploded views that between them show: the upper section 22U of the riser pipe 22; the flange connection 32; the sleeve 34; the upper cross-member 38 fixed to the sleeve 34; the shells 40 of the buoyant body 36; the collars 42 that encircle the sleeve 34; the bend restrictor 44; and the lifting padeyes 48.

FIGS. 6 and 7 also show other details. For example, it will be apparent that the lifting padeyes 48 are fixed to the upper cross-member 38 and protrude through respective slots 64 in the upper housing 58 that surrounds the funnel 54. It will also be apparent that there is a lower cross-member 66 fixed to a lower end of the sleeve 34, which provides further axial location for the shells 40 of the buoyant body 36. Also, the upper and lower cross-members 38, 66 are apt to support sacrificial anodes 68 that protect the steel parts from corrosion.

The lower cross-member 66 provides a connection point for the attachment of clump weights as will be explained later with reference to FIGS. 16 to 18. To this end, the underside of the lower cross-member 66 supports hanging padeyes 70 that protrude through respective slots 72 in a lower housing 74 surrounding the lower cross-member 66.

The lower cross-member 66 may also have another function, namely to provide an attachment point for the bend restrictor 44. In this respect, FIGS. 8 and 9 show that the lower cross-member 66 has a circular flange 76 that lies in a plane orthogonal to the common central longitudinal axis of the riser pipe 22 and the sleeve 34. The flange 76 is penetrated by an array of circumferentially-spaced holes 78 that have counterpart holes 80 in a parallel upper face of the bend restrictor 44. This allows the bend restrictor 44 to be bolted securely to the flange 76 of the lower cross-member 66 as shown in FIG. 9.

Turning next to FIGS. 10 to 16, these show a second embodiment of the invention. Many features are in common with the first embodiment shown in FIGS. 1 to 9 and so will not be repeated here; also, like numerals are used for like features. FIGS. 11 and 12 best show the main differences between the first and second embodiments.

FIG. 11 shows that the second embodiment has a longer and narrower bend restrictor 44. In this case, the bend restrictor 44 is parallel-sided along most of its length and tapers only near its lower end down to the diameter of the riser pipe 22 disposed concentrically within.

FIG. 12 shows an alternative arrangement for the interface between the riser pipe 22 and the hose 26. In this case, the socket 28 is recessed into the top face of an upper housing 58. Again, the upper housing 58 surrounds an upper cross-member 38 atop the uppermost shells 40 of the buoyant body 36. Also, the plug connector 30 has a straight-sided cylindrical body 82 in this example and the socket 28 has a complementary straight-sided recess 84. However, the recess 84 is surmounted by a frusto-conical guide surface 86 to guide the body 82 into alignment and engagement with the recess 84.

FIGS. 14 and 15 show clump weights in the form of chains 88 hung from hanging padeyes 70 supported by the lower cross-member 66. The weight of the chains 88 is necessary to overcome the buoyant upthrust of the buoy 24 so as to sink the riser tower 20 to the required depth upon installation. Locating the clump weights at the bottom of the buoy improves stability by lowering the centre of gravity or centre of buoyancy and by decreasing rotational moments.

Once the riser tower 20 has been anchored to the subsea facility 12 or to another foundation on the seabed 14, the chains 88 are removed so that the buoyant upthrust of the buoy 24 can apply the necessary tension to the riser pipe 22. Depending upon the water depth, divers or an ROV may be used to attach the chains 88 to suitable lifting lines and to release the chains 88 at the appropriate time for recovery to the surface. The lower end of the chain 88 is lifted and then the upper end of the chain 88 is disconnected from the hanging padeyes 70 below the buoy 24.

FIG. 16 shows an alternative hose arrangement. This is shown in relation to the second embodiment but it may also be used in the first embodiment shown in FIGS. 1 to 9. Here, the lower end of the hose 26 is defined by a rigid tubular dog-leg structure 90 that offsets the plug connector 30 laterally from the generally downward axis of the hose 26. The structure 90 is surmounted by a fixing point 92 to which a control wire 94 may be attached to control the position of the plug connector 30 for alignment with the socket 28.

Moving on now to FIGS. 17 and 18, these drawings exemplify how an installation vessel 96 may be adapted to install a riser tower 20 of the invention. Whilst FIGS. 17 and 18 depict elements of the second embodiment shown in FIGS. 10 to 16, it will be evident that the same principles can be applied to installation of the first embodiment shown in FIGS. 1 to 9.

The installation vessel 96 has a working deck 98 that supports a carousel 100 on which the major lower section 22L of the riser pipe 22 can be wound or spooled. In this respect, it will be noted that the composite riser pipe 22 has some flexibility to be bent elastically along its length if a sufficiently large minimum bend radius is observed. In principle, a reel with a horizontal axis could be used instead of a carousel to carry the lower section 22L of the riser pipe 22.

The lower section 22L of the riser pipe 22 is unspooled from the carousel 100 through a spooler 102 on the working deck 98 beside the carousel 100 and then is overboarded into the sea along a chute 104. At this stage, a tensioner 106 upstream of the chute 104 carries the weight load of the launched portion of the lower section 22L.

Once the lower section 22L of the riser pipe 22 has been fully unspooled from the carousel 100 and lowered into the sea, its weight load is transferred to a crane 108 on the working deck 98. As best shown in FIG. 18, a top flange part 110 of the lower section 22L is then engaged with a hang-off structure 112 outboard of the working deck 98. This leaves the remainder of the lower section 22L hanging in the water column beneath the installation vessel 96.

The working deck 98 supports a frame 114 that in turn supports the upper section 22U of the riser pipe 22 surrounded by the buoy 24. The frame 114 is shown here in a horizontal stowed position but can be pivoted about a horizontal axis into a vertical installation position. This pivoting movement upends the upper section 22U and the buoy 24 and brings them into alignment with the vertical axis of the lower section 22L hung off from the hang-off structure 112 below. It also brings a bottom flange part 116 of the upper section 22U into alignment with the top flange part 110 of the lower section 22L. The top and bottom flange parts 110, 116 can then be bolted together.

When united in this way, the top flange part 110 of the lower section 22L and the bottom flange part 116 of the upper section 22U together form the aforementioned flange connection 32 between the upper and lower sections 22U, 22L. This completes the full length of the riser pipe 22.

The crane 108 can now take the load of the riser tower 20 comprising the riser pipe 22 and the buoy 24 by attaching lifting lines to the lifting padeyes 48 shown in preceding figures. Clump weights are attached to the buoy 24 using the hanging padeyes 70 also shown in the preceding figures. This added ballast overcomes the buoyancy of the buoy 24 and allows the crane 108 to lower the riser tower 20 to the required depth. When the bottom end of the riser pipe 22 has been anchored to the subsea facility 12 or other subsea foundation, the clump weights can be removed from the buoy 24 and recovered to the surface by the crane 108.

Reference is now made to FIGS. 19*a* to 19*e*, which show the installation vessel 96 performing the abovementioned installation process in simplified, schematic form.

Figure 19C:
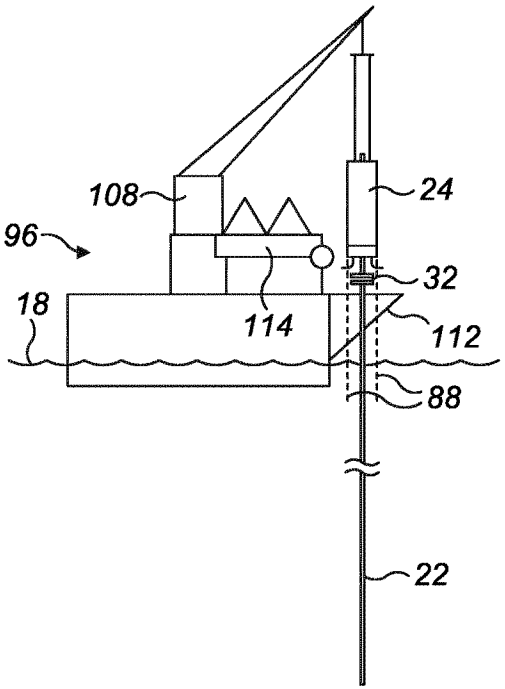
Figure 19B:
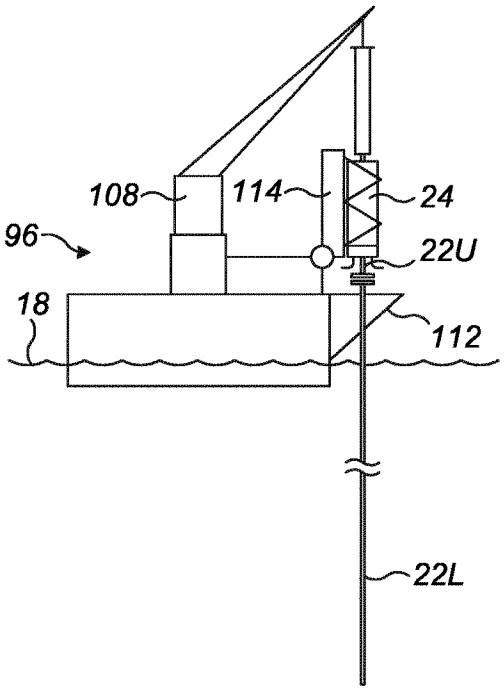
Figure 19A:
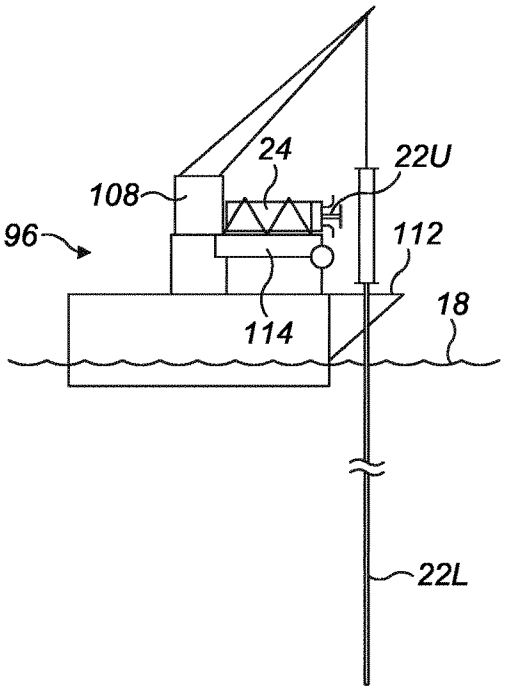

FIG. 19*a* shows the lower section 22L of the riser pipe 22 being lowered by the crane 108 for engagement with the hang-off structure 112. At this stage, the frame 114 that supports the buoy 24 and the upper section 22U of the riser pipe 22 is in the horizontal stowed position.

In FIG. 19*b*, the crane 108 has transferred the load of the lower section 22L to the hang-off structure 112. With the crane 108 now disengaged from the lower section 22L, the frame 114 has been pivoted into the vertical installation position. The buoy 24 and the upper section 22U have thereby been upended and brought into vertical alignment with the lower section 22L suspended from the hang-off structure 112.

FIG. 19*c* shows the flange connection 32 now made between the upper and lower sections 22U, 22L to complete the full length of the riser pipe 22. The crane 108 has now taken the load of the riser tower 20 comprising the riser pipe 22 and the buoy 24.

Also, clump weights exemplified here by chains 88 have been attached to the lower end of the buoy 24.

Figure 19D:
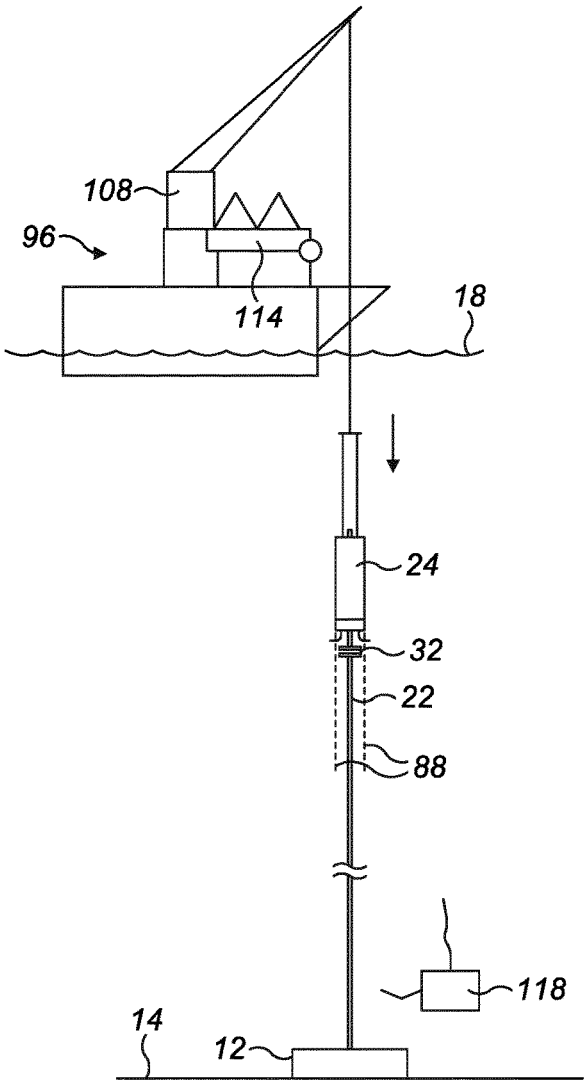
Figure 19E:
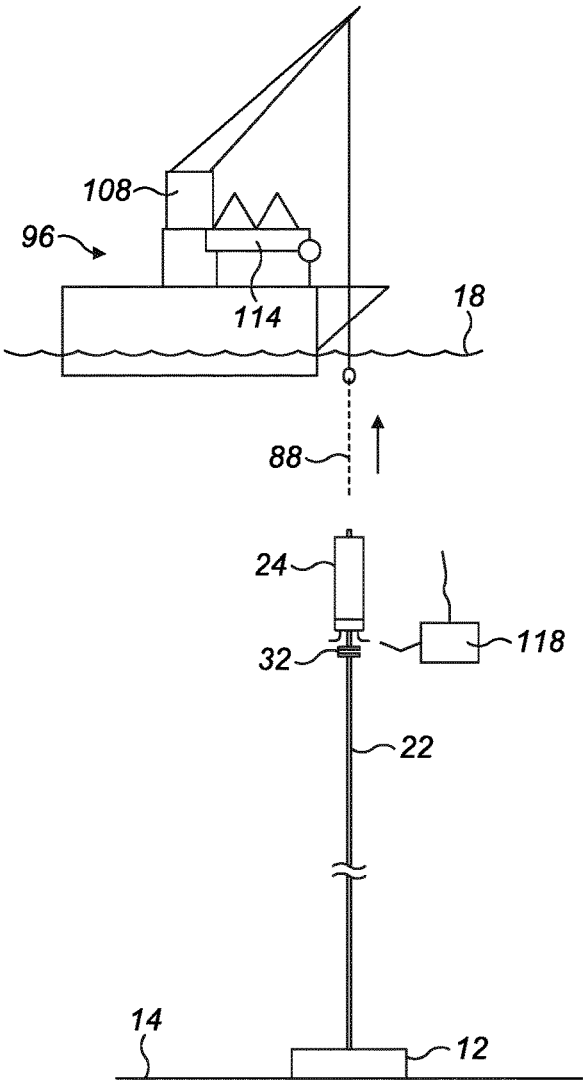

The added ballast of the chains 88 overcomes the buoyancy of the buoy 24 and allows the crane 108 to lower the riser tower 20 to the required depth in the water as shown in FIG. 19*d*. At that depth, the bottom end of the riser pipe 22 can be anchored to the subsea facility 12 as shown. Finally, as shown in FIG. 19*e*, the chains 88 can be removed from the buoy 24 and recovered to the surface by the crane 108. An ROV 118 is shown in attendance in FIGS. 19*d* and 19*e* to assist with the necessary connection, disconnection and recovery operations.

FIGS. 20 to 28 show various alternative arrangements for supporting clump weights.

In FIG. 20, a buoy 24 supports an array of parallel upright tubes 120 that are equi-angularly spaced around the central vertical axis of the buoy 24. In this example, there are three tubes 120; there could instead be two such tubes or four or more such tubes.

FIG. 21 shows how the tubes 120 may be used to support removable solid clump weights 122, such as beams, rods or bars, inserted into the open upper ends of the tubes 120. For removal, the clump weights 122 are lifted by a crane to pull them out of the tubes 120.

Whilst the solid clump weights 122 allow for the addition of ample ballast, FIG. 22 shows how the clump weights 122 could be supplemented by stud link chains 88 that may hang inside and/or outside the tubes 120. FIG. 22 also shows an offshore worker 124 beside a chain 88 to illustrate scale.

The chains 88 shown in FIG. 22 may be attached to or separate from the solid clump weights 122. Where the chains 88 are attached to the clump weights 122, the chains 88 make it easier to handle and grab the weights under water, for example by attaching a hook or a shackle to an upper link of a chain 88. Alternatively, chains 88 may be used alone, instead of the solid clump weights 122.

FIGS. 23 and 24 show solutions that enable clump weight chains 88 to be attached to the top of a buoy 24. In each case, an upper cross-member 38 supports hooks 126 on its outboard ends that enable chains 88 to be hooked in place. The chains 88 then hang beside and outside the buoy 24. This positioning has the advantage that the chains 88 are easily accessible for removal and retrieval.

Finally, FIGS. 25 to 28 show a further clump weight arrangement, in which solid clump weights 128 are supported on the exterior of a buoy 24.

A frame 130 at the bottom of the buoy 24 supports an array of upwardly-opening buckets or sockets 132 that are equi-angulary spaced around the central vertical axis of the buoy 24.

Part-circular solid clump weights 128 are assembled together as a lifting ring or flange that encircles the buoy 24. In this case, there are two semi-circular clump weights 128.

Each clump weight 128 has attachment points 134 on its upper side to allow lifting lines 136 to be attached. Each clump weight 128 also has angularity-spaced pins 138 on its underside that are spaced to align with and engage into the sockets 132. In this example, there are four sockets 132 and therefore each of the two clump weights 128 has two pins 138.

On each clump weight 128, one pin 138 is preferably longer than the other pin 138 as shown. This allows the longer pin 138 to be engaged with its socket 132 first and then to serve as a pivot that helps to guide the shorter pin 138 into an adjacent socket 132.

The clump weights 128 can be installed onto the frame 130 of the buoy 24 or removed from the frame 130 together as shown in FIGS. 26 and 27 or separately as shown in FIG. 28. In principle it would be possible for a single clump weight 128 to encircle the buoy 24 rather than being divided into parts.

As in some preceding embodiments, locating the clump weights 128 near the bottom end of the buoy 24 improves stability by lowering the centre of gravity or centre of buoyancy and by decreasing rotational moments.

The invention claimed is:

1. A subsea hydrocarbon export system, comprising:

a riser tower having a column extending from a seabed location to a sub-surface buoy that supports the column in an upright orientation, wherein the column communicates with a subsea tank for storing hydrocarbon fluids and with a subsea processing system for processing hydrocarbon fluids; and a subsea connector that is operable underwater to couple the column temporarily to a hose suspended from a surface shuttle tanker vessel for an export operation and to release the hose after the export operation;

wherein the subsea connector comprises an upwardly facing socket at an upper extremity of the column for receiving a plug connector of the hose; and wherein the buoy comprises one or more external tubes or sockets that open upwardly to receive at least one clump weight.

2. The system of claim 1, wherein the subsea tank serves as a foundation for the riser tower.

3. The system of claim 1, further comprising a subsea pump for pumping hydrocarbon fluids up the column to the subsea connector.

4. The system of claim 1, wherein the column extends through the buoy.

5. The system of claim 1, wherein the buoy surrounds an upper end portion of the column.

6. The system of claim 5, wherein the buoy comprises shell elements assembled together around the upper end portion of the column.

7. The system of claim 1, wherein the column comprises a connection between a major lower section and a minor upper section, the buoy being attached to the upper section of the column.

8. The system of claim 1, comprising at least one laterally projecting male formation on the column, wherein the male formation is engaged with a female interlocking formation of the buoy.

9. The system of claim 8, wherein the male formation surrounds the column.

10. The system of claim 8, wherein the male formation is formed integrally with the column.

11. The system of claim 1, wherein the buoy comprises a sleeve fixed to and surrounding the column.

12. The system of claim 11, further comprising an upper cross-member extending laterally from the sleeve, wherein the cross-member supports one or more lifting points.

13. The system of claim 12, wherein the upper cross-member also supports one or more attachment points for the attachment of at least one clump weight.

14. The system of claim 12, wherein one or more buoyant elements of the buoy bear against an underside of the upper cross-member to apply buoyant upthrust to the upper cross-member in use.

15. The system of claim 11, further comprising a lower cross-member extending laterally from the sleeve.

16. The system of claim 15, wherein the lower cross-member supports one or more attachment points for the attachment of at least one clump weight.

17. The system of claim 15, wherein one or more buoyant elements of the buoy rest upon the lower cross-member.

18. The system of claim 1, wherein a bend restrictor is attached to the buoy and extends along and around the column under the buoy.

19. The system of claim 1, further comprising at least one clump weight releasably attached to the buoy.

20. The system of claim 19, wherein the or each clump weight comprises a chain.

21. The system of claim 19, wherein the or each clump weight is a rigid structure attachable to the buoy.

22. The system of claim 1, wherein the buoy comprises non-floodable buoyancy.

23. The system of claim 22, wherein the buoy comprises rigid buoyant foam or macrospheres.

24. The system of claim 1, wherein the hose is a bonded polymer composite hose.

25. The system of claim 1, wherein the hose is longitudinally flexible and comprises a rigid guide structure at a distal end of the hose.

26. The system of claim 1, wherein the column is of pipe that can be wound onto a reel or carousel onboard an installation vessel, without substantial plastic deformation of the pipe.

27. The system of claim 1, wherein the column is of bonded polymer composite pipe.

28. The system of claim 1, wherein the column is of material that is substantially neutrally buoyant in sea water.

29. The system of claim 1, wherein the hose is connected to the column at a depth of between 30 m and 200 m underwater.

30. A method of exporting hydrocarbon fluids from a seabed location, the method comprising:

sailing a shuttle tanker vessel to a surface export location above a column that extends from the seabed location and communicates with a subsea tank for storing the hydrocarbon fluids to a sub-surface buoy, wherein the buoy supports the column in an upright orientation, and wherein the buoy comprises one or more external tubes or sockets that open upwardly to receive at least one clump weight;

suspending a hose from the vessel to reach the column;

operating a subsea connector underwater to couple the hose temporarily to the column for an export operation by inserting a plug connector of the hose into an upwardly facing socket at an upper extremity of the column;

during the export operation, causing hydrocarbon fluids to flow from the seabed location up the column and along the coupled hose to the vessel; and on completion of the export operation, releasing the hose from the column by removing the plug connector of the hose from the upwardly facing socket, lifting the hose to the vessel and sailing the vessel away from the surface export location.

31. The method of claim 30, comprising storing the hydrocarbon fluids at the seabed location before the export operation.

32. The method of claim 30, comprising processing the hydrocarbon fluids at the seabed location before or during the export operation.

33. The method of claim 30, comprising pumping the hydrocarbon fluids at the seabed location during the export operation to flow up the column.

34. A method of installing a subsea hydrocarbon export system, the method comprising:

lowering a major lower section of a column into water beneath an installation vessel;

suspending the lower section from the installation vessel;

positioning a buoy and a minor upper section of the column over the suspended lower section;

joining the upper section to the lower section to complete the column;

adding ballast to the buoy by attaching one or more clump weights to the buoy, wherein attaching one or more clump weights to the buoy comprises inserting at least part of a clump weight into an upwardly extending external tube of socket on the buoy;

lowering the buoy and the completed column into the water beneath the installation vessel to anchor a lower end of the column to a subsea facility comprising a subsea tank for storing hydrocarbon fluids at a seabed location, the buoy then being at a sub-surface location; and removing the added ballast from the buoy after anchoring the lower end of the column at the seabed location.

35. The method of claim 34, comprising unwinding the lower section of the column from shipboard storage while launching the lower section into the water.

36. The method of claim 34, comprising raising the buoy and the upper section from a stowed position on the installation vessel into an upright orientation when positioning the buoy and the upper section over the suspended lower section.

37. The method of claim 34, comprising attaching the or each clump weight to the buoy at a level beneath a mid-point of the buoy.

38. The method of claim 37, comprising attaching the or each clump weight to a lower end region of the buoy.

39. The method of claim 34, comprising attaching the or each clump weight to an upper end region of the buoy.

* * * * *